US010337292B2

(12) United States Patent
Hazel

(10) Patent No.: US 10,337,292 B2
(45) Date of Patent: Jul. 2, 2019

(54) DOWNHOLE COMPLETION SYSTEM AND METHOD

(71) Applicant: Welltec Oilfield Solutions AG, Zug (CH)

(72) Inventor: Paul Hazel, Aberdeen (GB)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 169 days.

(21) Appl. No.: 15/103,613

(22) PCT Filed: Dec. 12, 2014

(86) PCT No.: PCT/EP2014/077511

§ 371 (c)(1),
(2) Date: Jun. 10, 2016

(87) PCT Pub. No.: WO2015/086797

PCT Pub. Date: Jun. 18, 2015

(65) Prior Publication Data

US 2016/0312584 A1 Oct. 27, 2016

(30) Foreign Application Priority Data

Dec. 13, 2013 (EP) ..... 13197124

(51) Int. Cl.
*E21B 41/00* (2006.01)
*E21B 7/06* (2006.01)
(Continued)

(52) U.S. Cl.
CPC ..... *E21B 41/0035* (2013.01); *E21B 7/061* (2013.01); *E21B 33/12* (2013.01);
(Continued)

(58) Field of Classification Search
CPC ..... E21B 41/0035; E21B 43/30; E21B 34/06; E21B 7/061
See application file for complete search history.

(56) References Cited

U.S. PATENT DOCUMENTS 5,474,131 A 12/1995 Jordan et al.
2004/0016547 A1* 1/2004 Brunet ..... E21B 41/0042 166/313
(Continued)

FOREIGN PATENT DOCUMENTS

CN 103422812 A 12/2013
RU 2 074 944 C1 3/1997
(Continued)

OTHER PUBLICATIONS

International Search Report for PCT/EP2014/077511, dated May 29, 2015, 3 pages.
(Continued)

*Primary Examiner* — David J Bagnell
*Assistant Examiner* — Manuel C Portocarrero
(74) *Attorney, Agent, or Firm* — Nixon & Vanderhye P.C.

(57) ABSTRACT

The present invention relates to a completion method for completing a uniform inner bore downhole completion system in a reservoir in a formation, comprising the steps of drilling a hole in the formation, inserting a surface casing having an inner surface casing diameter, cementing an outer face of the surface casing to the hole, inserting a drilling head in the surface casing, drilling a main bore extending from the surface casing, the main bore having a first part and a second part, the second part comprising an end of the main bore, and the main bore having an inner main bore diameter which is substantially the same as the inner surface casing diameter of the surface casing, retracting the drilling head from the main bore and the surface casing, inserting a lower production casing in the second part of the main bore, the lower production casing having annular barriers and an inner diameter, setting at least one of the annular barriers of the lower production casing, inserting the drilling head into the
(Continued)

first part of the main bore below the surface casing, drilling a lateral bore from the first part of the main bore, the lateral bore having an inner lateral bore diameter which is substantially equal to the inner main bore diameter, retracting the drilling head from the lateral bore, inserting a lateral production casing fully in the lateral bore, the lateral production casing having annular barriers and an inner diameter which is substantially equal to the inner diameter of the lower production casing providing a uniform inner bore completion having the same inner diameter in all production casings, enabling service also in the lateral production casing while service of the main production casing is performed, setting at least one of the annular barriers of the lateral production casing, inserting a main production casing in the first part of the main bore, so that the main production casing is fluidly connected with the lower production casing, the main production casing having annular barriers and an inner diameter which is substantially equal to the inner diameter of the lower production casing, setting the annular barriers of the main production casing, and providing an opening in the main production casing opposite the lateral production casing fluidly connecting the lateral production casing with the main production casing, so that the lower production casing, the main production casing and the lateral production casing is in fluid communication. Furthermore, the present invention relates to a downhole completion system for enhancing hydrocarbon-containing fluid production in a reservoir.

19 Claims, 30 Drawing Sheets

(51) Int. Cl.

| | |
|---|---|
| ***E21B 33/12*** | (2006.01) |
| ***E21B 33/14*** | (2006.01) |
| ***E21B 34/06*** | (2006.01) |
| ***E21B 43/10*** | (2006.01) |
| ***E21B 43/14*** | (2006.01) |
| ***E21B 43/26*** | (2006.01) |

(52) U.S. Cl.
CPC ..... *E21B 33/14* (2013.01); *E21B 34/06* (2013.01); *E21B 43/105* (2013.01); *E21B 43/14* (2013.01); *E21B 43/26* (2013.01)

(56) References Cited

U.S. PATENT DOCUMENTS

| | | | | |
|---|---|---|---|---|
| 2005/0241831 | A1 | 11/2005 | Steele et al. | |
| 2007/0034384 | A1 | 2/2007 | Pratt | |
| 2007/0051517 | A1* | 3/2007 | Surjaatmadja ..... | E21B 33/127 166/308.1 |

FOREIGN PATENT DOCUMENTS

| | | |
|---|---|---|
| RU | 79 935 U1 | 1/2009 |
| WO | WO 00/46484 | 8/2000 |

OTHER PUBLICATIONS

Written Opinion of the ISA for PCT/EP2014/077511, dated May 29, 2015, 8 pages.
Notification of the First Office Action dated Apr. 4, 2018 in Chinese Application No. 201480065342.X, with English translation (11 pages).
Decision on Patent Grant for Invention dated Jun. 6, 2018 in Russian Application No. 2016125222/03(039516), with English translation (32 pages).

* cited by examiner

DOWNHOLE COMPLETION SYSTEM AND METHOD

This application is the U.S. national phase of International Application No. PCT/EP2014/077511 filed 12 Dec. 2014, which designated the U.S. and claims priority to EP Patent Application No. 13197124.4 filed 13 Dec. 2013, the entire contents of each of which are hereby incorporated by reference.

FIELD OF THE INVENTION

The present invention relates to a completion method for completing a uniform inner bore downhole completion system in a reservoir. The present invention also relates to a downhole completion system for enhancing hydrocarbon-containing fluid production in a reservoir.

BACKGROUND ART

In recent years, wells have been made as intelligent wells in which a lot of equipment has been installed when completing the well to be able to adjust the well over time from surface through control lines and electronic communication. This has been done in order to enhance the oil or gas production. However, experience has shown that making a perfect well operable from surface is impossible and that further development of these wells is necessary. However, since these well are highly equipped with lines and electronics, it is very risky and sometimes even impossible to intervene with a tool afterwards to adjust and develop the well.

Furthermore, such intelligent wells can, due to their level of equipment, only be made with up to eight production zones and only as vertical wells. Therefore, the manifold or base structure from which the well runs has to be very large in order to be able reach out in the reservoir to a satisfactory extent.

In the more conventional way, the laterals are drilled through the production casing in order to reach further out into the reservoir and thus optimise the oil or gas production. However, when making cased laterals, the main production casing needs to have an enlarged inner diameter in order for the lateral casing to enter there through, which increases the costs of making such a completion substantially.

SUMMARY OF THE INVENTION

It is an object of the present invention to wholly or partly overcome the above disadvantages and drawbacks of the prior art. More specifically, it is an object to provide an improved downhole completion system.

The above objects, together with numerous other objects, advantages and features, which will become evident from the below description, are accomplished by a solution in accordance with the present invention by a completion method for completing a uniform inner bore downhole completion system in a reservoir in a formation, comprising the steps of:

- drilling a hole in the formation,
- inserting a surface casing having an inner surface casing diameter,
- cementing an outer face of the surface casing to the hole,
- inserting a drilling head in the surface casing,
- drilling a main bore extending from the surface casing, the main bore having a first part and a second part, the second part comprising an end of the main bore, and the main bore having an inner main bore diameter which is substantially the same as the inner surface casing diameter of the surface casing,
- retracting the drilling head from the main bore and the surface casing,
- inserting a lower production casing in the second part of the main bore, the lower production casing having annular barriers and an inner diameter,
- setting at least one of the annular barriers of the lower production casing,
- inserting the drilling head into the first part of the main bore below the surface casing,
- drilling a lateral bore from the first part of the main bore, the lateral bore having an inner lateral bore diameter which is substantially identical or equal to the inner main bore diameter,
- retracting the drilling head from the lateral bore,
- inserting a lateral production casing fully in the lateral bore, the lateral production casing having annular barriers and an inner diameter which is substantially equal to the inner diameter of the lower production casing providing a uniform inner bore completion having the same inner diameter in all production casings, enabling service also in the lateral production casing while service of the main production casing is performed,
- setting at least one of the annular barriers of the lateral production casing,
- inserting a main production casing in the first part of the main bore, so that the main production casing is fluidly connected with the lower production casing, the main production casing having annular barriers and an inner diameter which is substantially equal to the inner diameter of the lower production casing,
- setting the annular barriers of the main production casing, and
- providing an opening in the main production casing opposite the lateral production casing fluidly connecting the lateral production casing with the main production casing, so that the lower production casing, the main production casing and the lateral production casing is in fluid communication.

The main production casing may be abutting, overlapping and/or connected with the lower production casing.

When completing a prior art well having cased laterals, the main production casing is inserted first, and subsequently, the lateral is made by drilling a hole in the main production casing and further out in the formation. Thus, the inner diameter of the main production casing needs to be larger than the inner diameter of the main production casing. When the completion is planned, the lateral diameter defines the minimum inner diameter of the main production casing, as the drilling head must be able to enter through the main production casing. Thus, the main production casing and the main bore need to be larger than in the completion system of the present invention. Therefore, as the main production casing of the present invention is substantially slimmer and thus less material-demanding, it is less expensive to drill the completion system of the present invention and less expensive to manufacture the components. Furthermore, the lateral production casing and the main production casing are mounted from identical components, which minimises the need of spares when assembling the casings.

In an embodiment, the lateral bore may have a first part and a second part, the second part comprising an end of the lateral bore, and the lateral production casing may be a lower lateral production casing arranged in the second part of the lateral bore, and before the step of inserting the main production casing in the first part of the main bore, the method may comprise the steps of drilling a sub lateral bore extending from the first part of the lateral bore, the sub lateral bore having an inner sub lateral bore diameter which is substantially equal to the inner main bore diameter; inserting a sub lateral production casing in the sub lateral bore, the sub lateral production casing having annular barriers and an inner diameter which is substantially equal to the inner diameter of the lower production casing; setting the annular barriers of the sub lateral production casing; inserting a second lateral production casing arranged in the first part of the lateral bore; and setting the annular barriers of the second lateral production casing.

The completion method described above may further comprise the step of providing an opening in the second lateral production casing opposite the sub lateral production casing, the opening fluidly connecting the sub lateral production casing with the second lateral production casing before or after the step of providing an opening in the main production casing.

In an embodiment, the sub lateral bore may have a first part and a second part, the second part comprising an end of the lateral bore, and the sub lateral production casing may be a lower sub lateral production casing arranged in the second part of the sub lateral bore, and before the step of inserting a main production casing in the first part of the main bore, the method may comprise the steps of drilling a secondary sub lateral bore extending from the first part of the sub lateral bore, the secondary sub lateral bore having an inner secondary sub lateral bore diameter which is substantially equal to the inner main bore diameter; inserting a secondary sub lateral production casing in the secondary sub lateral bore, the secondary sub lateral production casing having annular barriers and an inner diameter which is substantially equal to the inner diameter of the lower production casing; setting the annular barriers of the secondary sub lateral production casing; inserting a second sub lateral production casing arranged in the first part of the sub lateral bore; and setting the annular barriers of the second sub lateral production casing.

The completion method described above may further comprise the step of providing an opening in the secondary sub lateral production casing opposite the secondary sub lateral production casing, the opening fluidly connecting the secondary sub lateral production casing with the second sub lateral production casing before or after the step of providing an opening in the main production casing.

Furthermore, the steps of providing one or more lateral bores, one or more sub lateral bores, one or more secondary sub lateral bores, and so forth with production casings may be performed before the step of inserting a main production casing in the first part of the main bore.

The completion system is thus made by building up the system from the end of the well.

The completion method described above may further comprise the step of inserting an openhole whipstock in the first part of the main bore before drilling the lateral bore.

Moreover, the completion method may further comprise the step of expanding the annular barriers by pressurising the production casing simultaneously or subsequently to the step of setting at least one of the annular barriers.

In addition, the completion method may further comprise the step of fracturing the formation through the production casing, such as the lower production casing, before the step of drilling the lateral bore.

The step of fracturing the production casing may be performed by means of an isolation tool having a hollow tube and two circumferenting annular inflatable packers adapted to isolate a fracturing zone opposite a zone in the formation to be fractured.

In one embodiment, the step of inserting the lower production casing may be performed by means of an isolation tool having a hollow tube and two circumferenting annular inflatable packers adapted to isolate a fracturing zone opposite a zone in the formation to be fractured.

Furthermore, a plug may be set in the lower production casing for protecting the lower production casing during subsequent steps.

Moreover, the plug may be set in the part of the lower production casing closest to the surface casing.

The completion method described above may further comprise the step of mounting the production casing from a plurality of components having equal inner diameters.

Also, the completion method may further comprise the step of inserting an openhole whipstock in the first part of the lateral bore.

Additionally, the completion method may further comprise the step of fracturing the formation through the lower lateral production casing before the step of drilling the sub lateral bore.

Moreover, the completion method may further comprise the step of aciding the formation through the lower production casing before the step of drilling the lateral bore.

In addition, the completion method may further comprise the step of opening an inflow valve.

Also, the completion method may further comprise the step of opening the fracturing port.

Moreover, the completion method may further comprise the step of expanding the upper part of the lateral production casing.

Additionally, the completion method may further comprise the steps of opening the inflow control devices in the casings.

The completion method described above may further comprise the step of making a lateral junction assembly by the following steps:

- inserting an expansion tool or an isolation tool at least partly in the lateral production casing, the tool being surrounded by an expandable tubular, the expandable tubular having ends connected to the expandable tubular, the tool having an aperture opposite the expandable tubular,
- expanding the expandable tubular by forcing pressurised fluid through the aperture until the expandable tubular presses against an inner face of the main production casing and the lateral production casing,
- retracting the tool leaving the expandable tubular in the production casings,
- inserting a removing tool into the main production casing,
- removing part of the expandable tubular projecting inwards in the main production casing,
- removing part of the expandable tubular projecting inwards in the lateral production casing,
- drilling an opening in the expandable tubular for providing access to the lower production casing, and
- removing the removing tool from the completion.

The present invention furthermore relates to a completion production method for enhancing a production of hydrocarbon-containing fluid in a reservoir through a downhole completion system, the method comprising the steps of:

- adjusting an inflow volume of inflow control devices for providing optimum fluid flow from the main casing and/or side track casings, and/or inserting and/or replacing inflow control devices in the casings.

In an embodiment, the steps of adjusting, inserting and replacing inflow control devices may be performed by a downhole tool submerged into the casings.

The casings may be flushed with well fluid or fluid comprising chemicals.

Additionally, a ball may be dropped into the side track casing before the pressurising step.

Moreover, the method may comprise the step of setting a plug in the production casing.

In the completion method described above, one or more inflow control devices may be mounted in the casings.

Moreover, the completion method described above may further comprise the step of opening the inflow control devices in the casings.

Additionally, sensors may be activated, and data from the sensors may be transmitted wirelessly.

Furthermore, the completion method described above may comprise the step of flushing an annulus before expanding the annular barriers.

In addition, the completion method as described above may comprise the step of fracturing the formation after expanding the annular barriers.

Also, the completion production method described above may comprise the step of transmitting data received from the sensors and/or the inflow control devices to the surface.

Further, the completion production method may comprise the step of interpreting the data received regarding formation pressure, flow, content, production and/or sweep for facilitating optimisation of the productivity of the completion system.

Moreover, the completion production method may comprise the step of determining on the basis of data received whether to adjust or replace inflow control devices in the casings or to insert additional inflow control devices in the blank parts by means of the downhole tool.

Finally, the completion production method described above may comprise the steps of calibrating, adjusting, inserting and/or replacing the sensors by means of the downhole tool which is movable in the casings.

The present invention furthermore relates to a downhole completion system for enhancing hydrocarbon-containing fluid production in a reservoir, the downhole completion system being provided by the completion method according to any of the proceeding claims, and the downhole completion system comprising:

- a surface casing inserted and cemented in a hole, the surface casing having an inner surface casing diameter,
- a main bore extending from the surface casing, the main bore having a first part and a second part, the second part comprising an end of the main bore, and the main bore having substantially the same inner main bore diameter as the inner surface casing diameter of the surface casing,
- a lower production casing arranged in the second part of the main bore, the lower production casing having annular barriers and an inner diameter,
- a lateral bore extending from the first part of the main bore, the lateral bore having an inner lateral bore diameter,
- a lateral production casing fully arranged in the lateral bore, the lateral production casing having annular barriers and an inner diameter, the lateral production casing and the lower production casing providing a uniform inner bore completion having the same inner diameter in all production casings,
- a main production casing arranged in the first part of the main bore in fluid communication with the lower production casing, the main production casing having annular barriers and an inner diameter which is substantially equal to the inner diameter of the lower production casing, and
- an opening in the main production casing opposite the lateral production casing, the opening fluidly connecting the lateral production casing with the main production casing, so that the main production casing is fluidly connected with the lower production casing, wherein the inner lateral bore diameter is substantially equal to the inner main bore diameter, and wherein the inner diameter of the lateral production casing is substantially equal to the inner diameter of the lower production casing.

In an embodiment, each annular barrier may comprise a tubular part mounted as part of the casing, and a metal expandable sleeve surrounding the tubular part with an opening through which fluid enters to expand the sleeve, the main casing being fluidly connected with the well control means.

Furthermore, the main production casing may be formed by a first main production casing and a second main production casing, and the second main production casing may be arranged in the first part of the main bore between the lower production casing and the first main production casing.

The downhole completion system described above may further comprise a second lateral bore extending from the first part of the main bore, and a second lateral production casing arranged in the second lateral bore, the second lateral production casing having annular barriers and an inner diameter, the inner diameter of the second lateral production casing being substantially equal to the inner diameter of the lower production casing.

The lateral bore may have a first part and a second part, the second part comprising an end of the lateral bore, and the lateral production casing may be a lower lateral production casing arranged in the second part of the lateral bore, the lower lateral production casing having annular barriers and an inner diameter, and a sub lateral bore may extend from the first part of the lateral bore, and a sub lateral production casing may be arranged in the sub lateral bore, the sub lateral production casing having annular barriers and an inner sub lateral casing diameter, and a second lateral production casing may be arranged in the first part of the lateral bore, the second lateral production casing having annular barriers and an inner diameter being substantially equal to the inner diameter of the lower lateral production casing, and an opening in the second lateral production casing may be arranged opposite the sub lateral production casing, the opening fluidly connecting the sub lateral production casing with the second lateral production casing, wherein the inner sub lateral casing diameter is substantially equal to the inner diameter of the lower production casing.

Furthermore, the production casings may be mounted from a plurality of components having equal inner diameters, the components being selected from the group of annular barriers, inflow control valves, fracturing ports, sensor modules, blank casing parts or junctions.

The downhole completion system as described above may further comprise a lateral junction assembly arranged partly in the main production casing and partly in the lateral production casing.

Further, the lateral junction assembly may comprise an expandable tubular which may be expanded by an expansion tool.

Also, the annular barriers may be metal annular barriers, swellable packers, elastomeric packers or similar barriers.

In addition, the inflow control device may be volume-adjustable.

Moreover, a connection part may be arranged between the main casing and the side track casing.

Additionally, the production casings and/or the connection parts may comprise one or more sensors.

Further, the inflow control device may be volume-adjustable.

Moreover, the production casing may comprise an inflow control device.

Also, a plurality of inflow control devices may be arranged between two adjacent annular barriers.

The completion system may further comprise a base structure positioned on a seabed, a rig, a platform or on the ground.

Furthermore, the completion system may further comprise a well control means which may comprise a blow-out-preventer (BOP) and/or a wellhead.

Moreover, a connection part may be arranged between the main production casing and the lateral production casing.

The production casings may be mounted from tubular casing parts, and some of the tubular casing parts may be blank parts.

A plurality of lateral production casings may be arranged along the main casing.

In addition, a plurality of lateral production casings may be arranged between two adjacent annular barriers.

The downhole completion system may comprise sub lateral production casings.

Additionally, the sub lateral production casing may comprise an inflow control device, sensors and/or fracturing ports.

The downhole completion system may comprise secondary sub lateral production casings.

Additionally, the secondary sub lateral production casing may comprise an inflow control device, sensors and/or fracturing ports.

A plurality of inflow control devices may be arranged between two adjacent annular barriers.

Furthermore, the system may comprise a plurality of main production casings fluidly connected with well control means supported on the base structure.

Moreover, the plurality of main production casing casings may each comprise one or more lateral production casings.

Also, a secondary sub-side track casing may be connected with a tertiary sub lateral production casing arranged between two adjacent annular barriers.

Further, the tertiary sub lateral production casing may comprise an inflow control device.

Further, the production casings may comprise one or more fracs or fracturing ports between two annular barriers.

An inner diameter of the production casings may be larger than 5.5 cm, preferably larger than 7 cm.

Moreover, the casings and/or the connection parts may comprise one or more sensors.

The sensors may be arranged with a mutual distance between them.

Furthermore, the completion system may further comprise a setting tool and/or an isolation tool.

Also, the system may further comprise a downhole tool which is submerged into the casing for inserting or replacing a sensor in the casing.

Additionally, the tool may have a magazine of sensors.

Furthermore, the tool may be adapted to read data from the sensors and/or calibrate the sensors and/or recharge power supplies for the sensors.

Finally, the tool may be adapted for inserting, replacing, and/or adjusting an inflow control device.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 16:
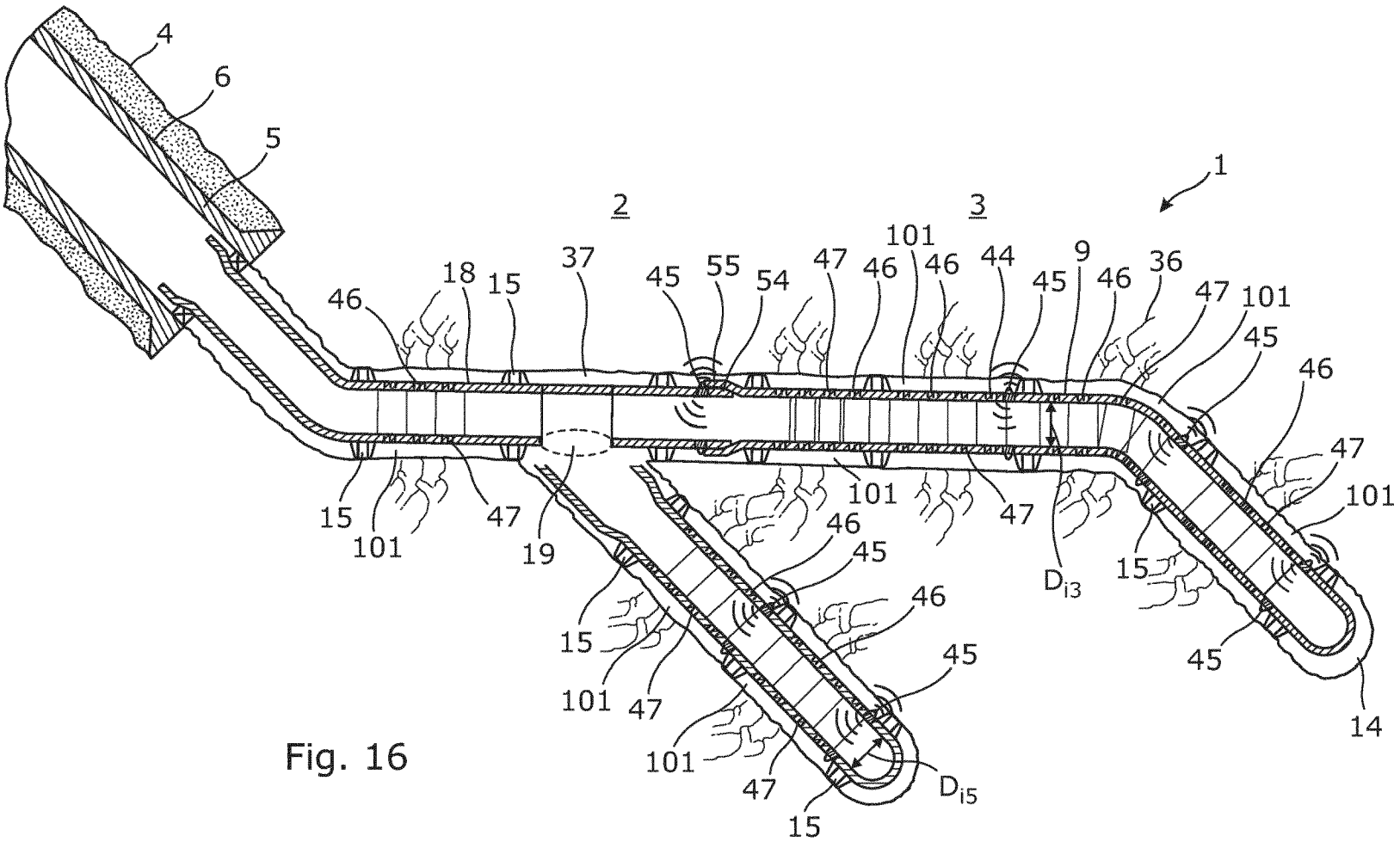
FIG. 16 shows a cross-sectional view of the downhole completion system.
Figure 17:
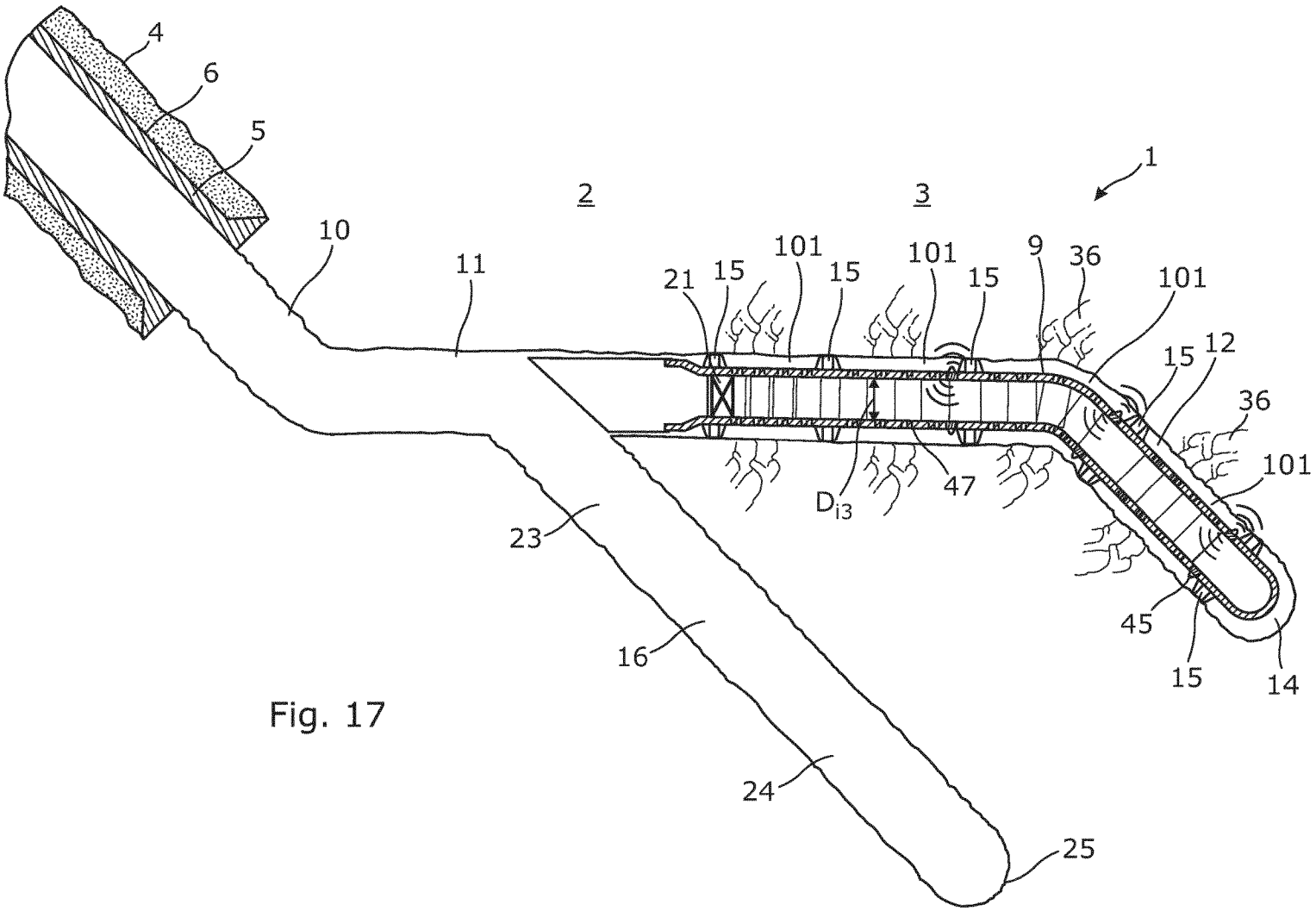
FIG. 17 shows a cross-sectional view of a lateral bore which has been drilled.

FIG. 16 shows a downhole completion system 1 having a uniform inner bore for enhancing hydrocarbon-containing fluid production in a well in a reservoir 2 in a formation 3. The downhole completion system 1 comprises a hole 4 in the formation 3 and a surface casing 5 having an inner surface casing diameter cemented on an outer face 6 of the hole 4. Further down, the completion system 1 comprises a main bore 10 having a first part 11 and a second part 12, the second part having an end 14 of the bore. A lateral bore 16 extends from the first part 11 of the main bore 10. A lower production casing 9 is arranged in the second part 12 of the main bore 10 below the surface casing, and a lateral production casing 17 is fully arranged ("fully" meaning arranged in its full extension in the lateral bore 16). A second main production casing 18, 18*b* is at its first end 54 connected to a top 55 of the lower main production casing 9, and at a second end 56 of the second main production casing 18, the casing 18 is connected to the surface casing 5 or, in another embodiment (shown in FIGS. 11-14), to a first main production casing 18, 18*a* arranged closer to the top of the well. The first and second main production casings 18*a*, 18*b* is, in this embodiment, one main production casing 18. The completion system 1 further comprises an opening 19 provided in the main production casing 18 opposite the lateral production casing 17, so that the lateral production casing is fluidly connected with the main production casing 18. The completion is thus provided as a uniform inner bore completion having the same inner diameter in all production casings, hence allowing service also in the lateral production casing while service of the main production casing is performed. The main production casing 18 is fluidly connected with the lower production casing, and fluidly connected with the lateral production casing 28. By dividing the main casing into the lower production casing and the production casing 18, the lateral production casing can be made with the same inner diameter as the main casing. This is further made possible, because the lateral production casing is fully inserted into the lateral bore.

As shown in FIG. 16, each of the production casings of the downhole completion system 1 comprises annular barriers 15 for centralising the production casings and isolating production zones 101. The downhole completion system 1 may further comprise an inflow control device 46 and frac ports. The production casings may subsequently be provided with openings 19 instead of having inflow control devices 46 pre-installed. These openings 19 may be used for fracturing so that frac ports do not have to part of the production casings. The downhole completion system 1 may further comprise sensors 45 for subsequently monitoring the production; however, such sensors may also be installed later on.

Figure 1:
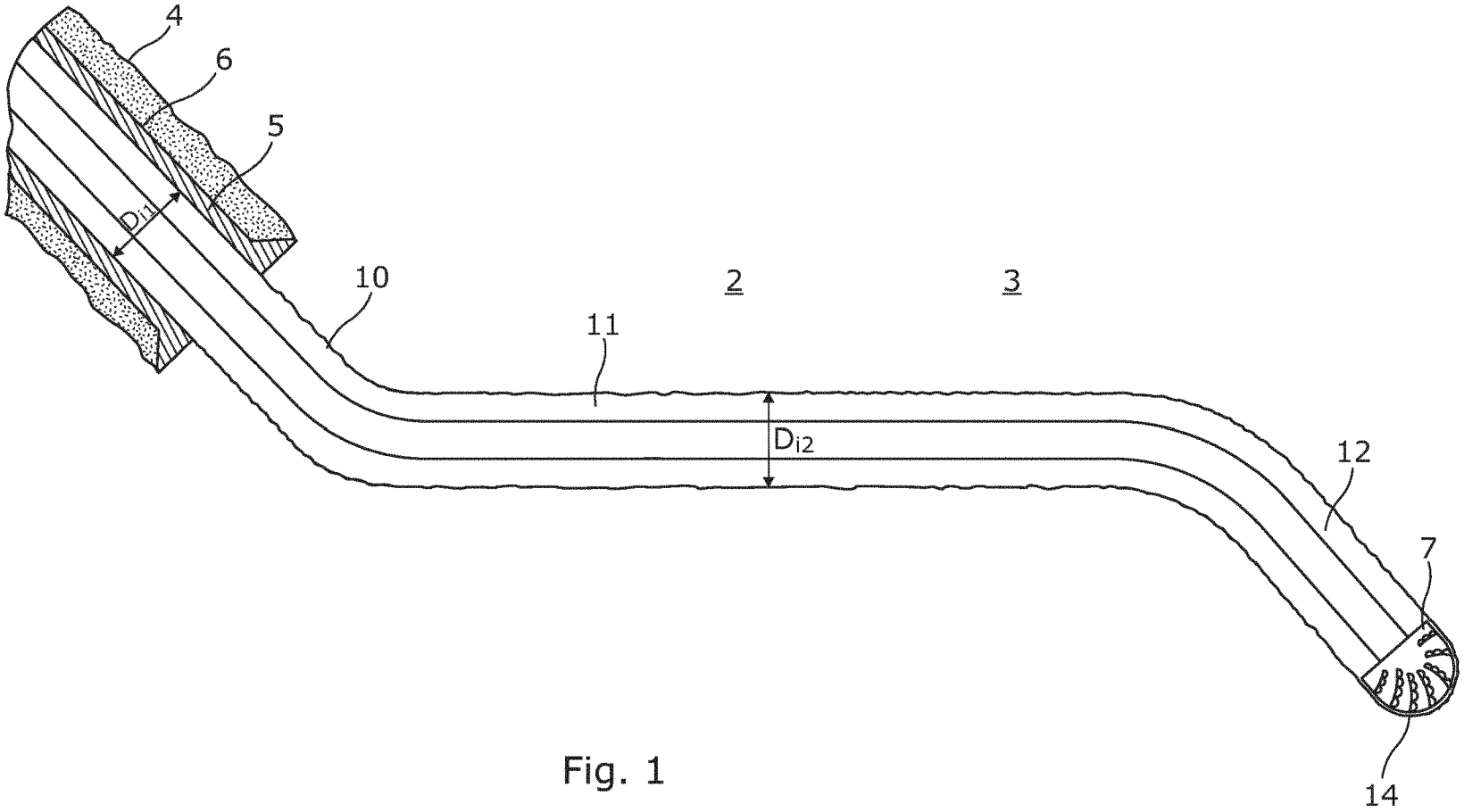
FIG. 1 shows a cross-sectional view of a main bore being drilled.
Figure 2:
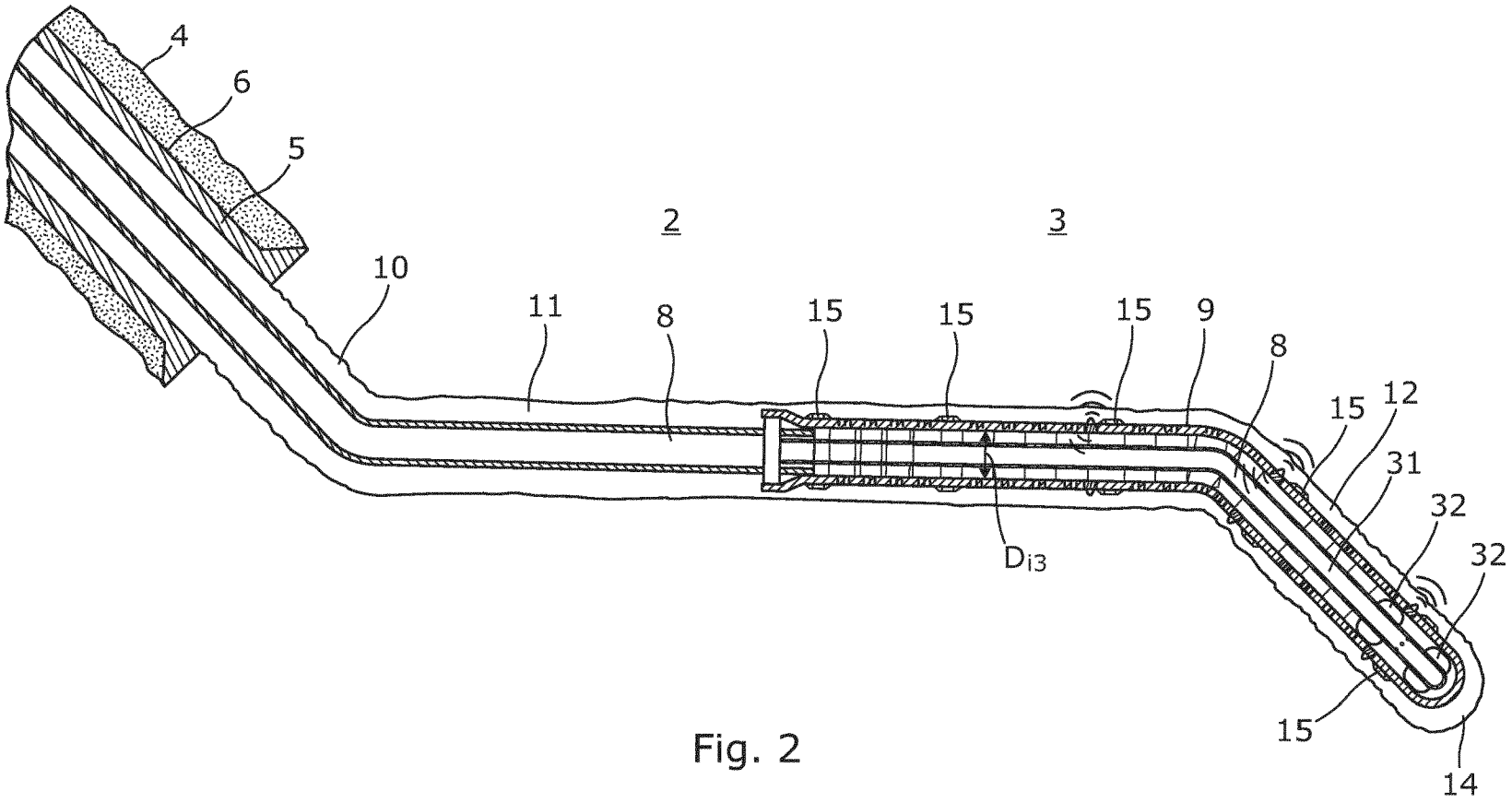
FIG. 2 shows a cross-sectional view of a lower main production casing being installed in the main bore.

FIGS. 1-15 show a completion method for completing the downhole completion system 1 in the reservoir 2 in the formation 3. First, a hole 4 is drilled in the formation 3, and then, a surface casing 5 having an inner surface casing diameter $D_{i1}$ is inserted in the hole 4 and subsequently cemented on an outer face 6 of the surface casing to the hole. Subsequently, a drilling head 7 is inserted in the surface casing 5, drilling a main bore 10 extending from the surface casing, as shown in FIG. 1. The main bore 10 has a first part 11 and a second part 12, and the second part comprises an end 14 of the main bore. The main bore 10 has an inner main bore diameter $D_{i2}$ which is substantially the same as the inner surface casing diameter $D_{i1}$ of the surface casing 5. Then, the drilling head 7 is retracted from the main bore 10 and the surface casing 5 in order to insert a lower production casing 9 in the second part 12 of the main bore. The lower production casing 9 has a plurality of annular barriers 15 and an inner diameter $D_{i3}$. When the lower production casing 9 is arranged in the predetermined position in the second part 12 of the main bore 10, one or more of the annular barriers 15 of the lower production casing 9 is/are set. The annular barriers 15 are set in different ways depending on the type of annular barriers. Each annular barrier 15 of FIGS. 1-15 has an expandable sleeve which is expanded by pressurising the production casing from within, either locally by means of an inflation tool 8 or by pressurising the casing or part of the casing with an internal fluid, as shown in FIG. 2.

Figure 3:
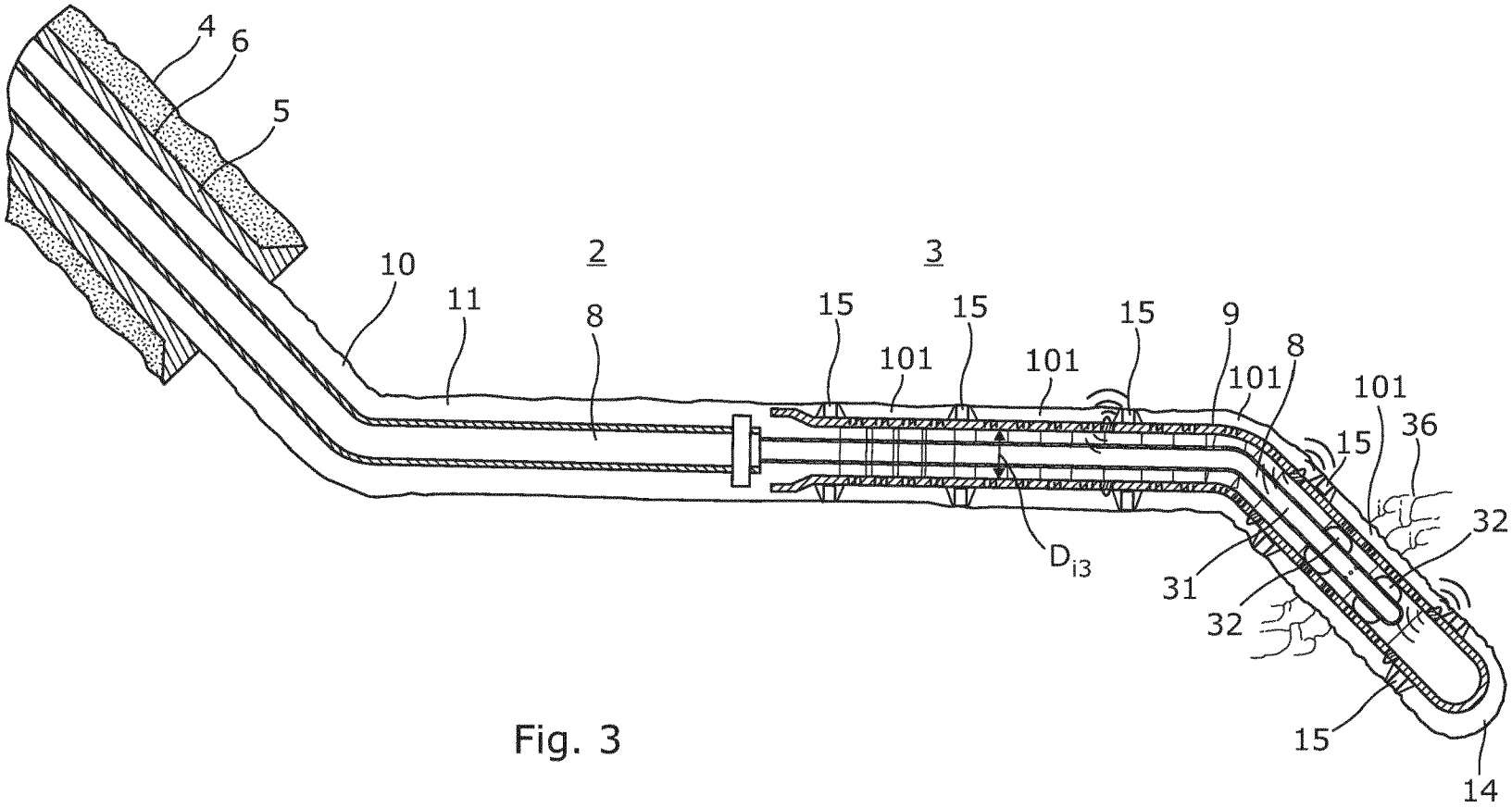
FIG. 3 shows a cross-sectional view of annular barriers of the lower main production casing of FIG. 2 being expanded.

The annular barrier 15 nearest the end 14 of the main bore 10 is pressurised by the inflation tool 8 having a hollow tube 31 and two circumferenting annular inflatable packers 32 adapted to isolate a zone opposite an opening in the lower production casing 9 for expanding the end annular barrier. The rest of the annular barriers 15 are expanded by pressurising the lower production casing 9 from within, thereby expanding the rest of the annular barriers to simultaneously isolate the production zones 101, as shown in FIG. 3. Subsequently, the inflation tool 8 is used to create fractures 36 in the formation in one production zone 101 at a time, as illustrated in FIGS. 3 and 4.

Figure 4:
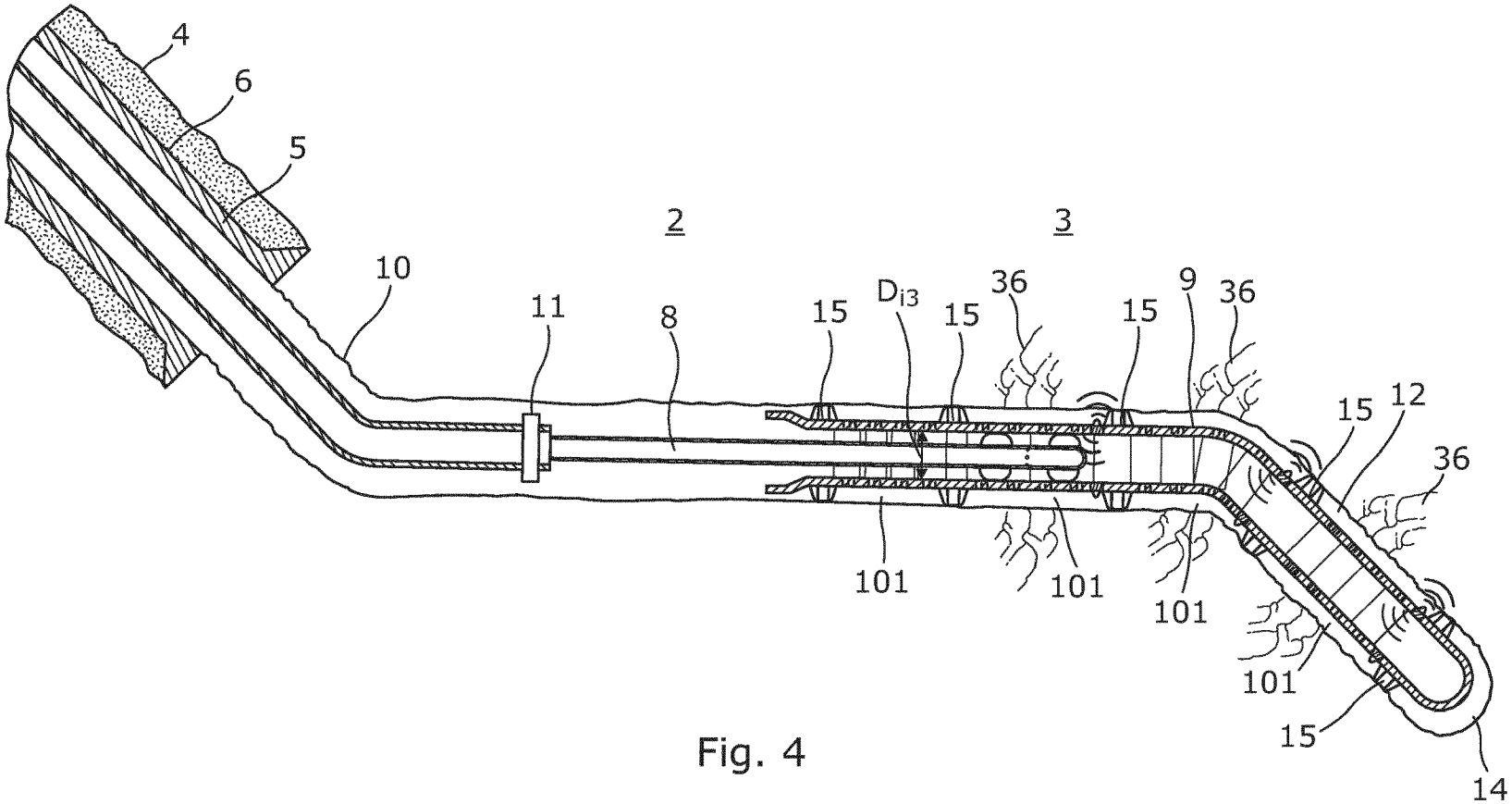
FIG. 4 shows a cross-sectional view of the lower main production casing of FIG. 2 where the formation is being fractured.
Figure 5:
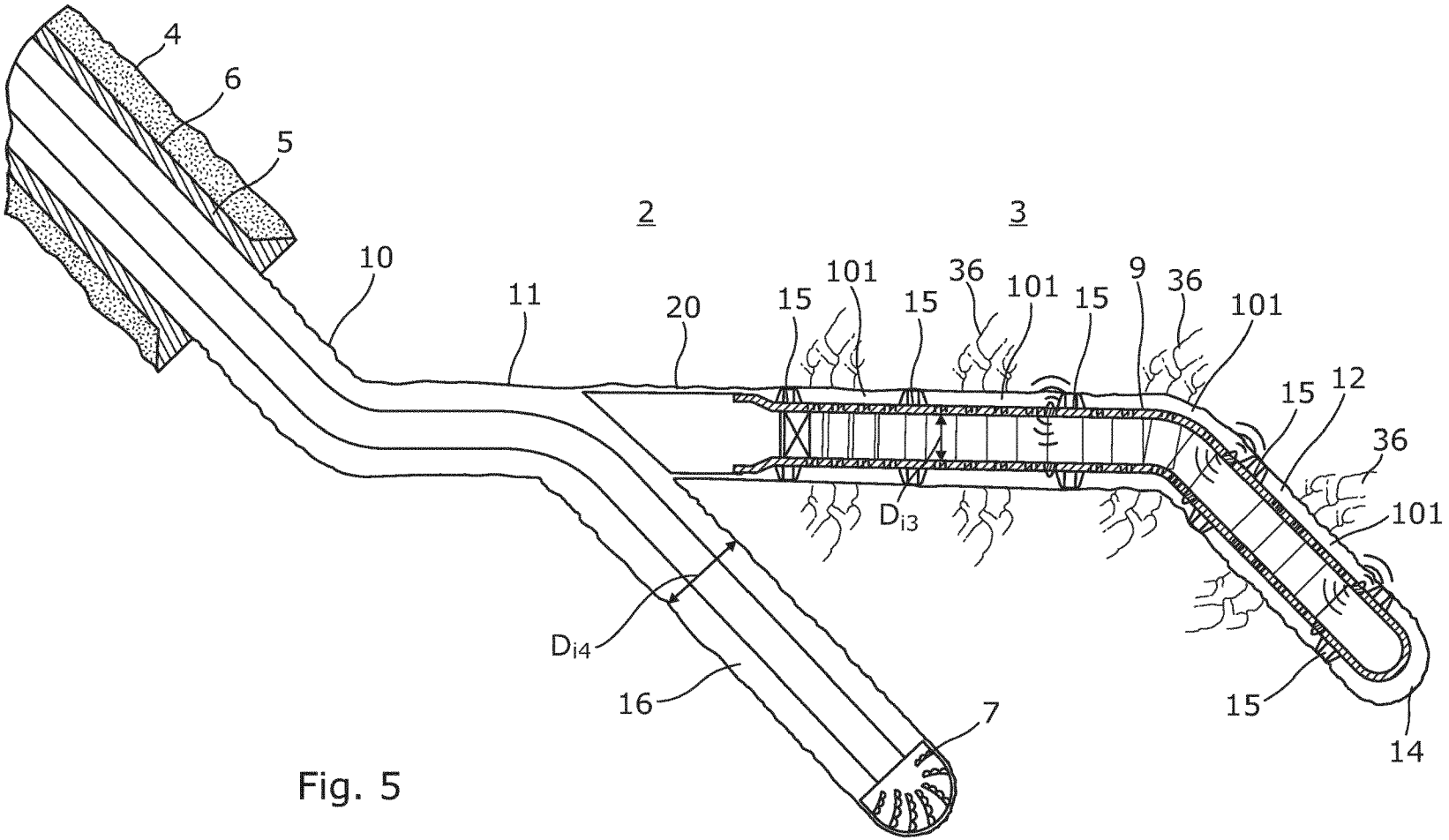
FIG. 5 shows a cross-sectional view of a lateral bore being drilled.
Figure 6:
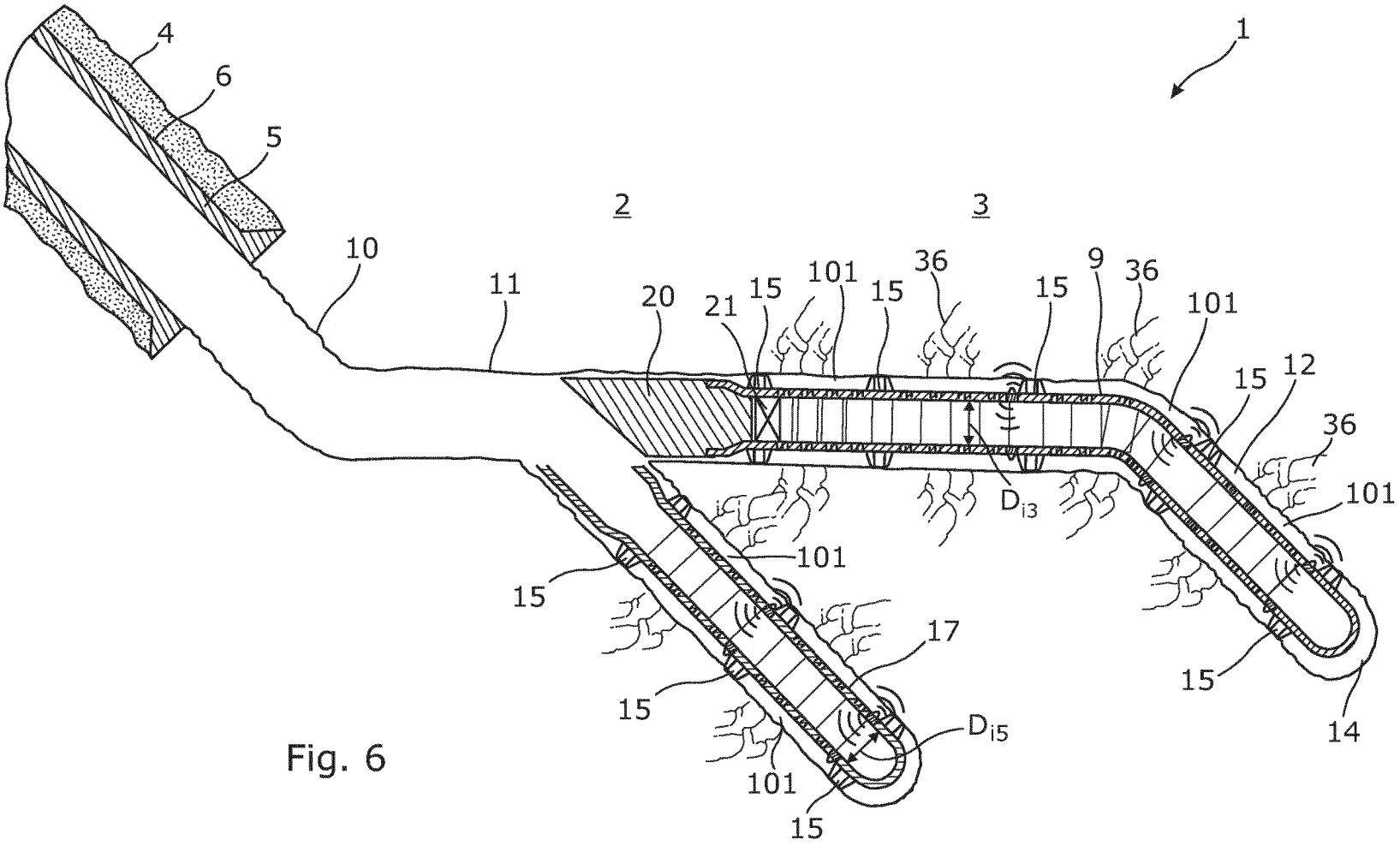
FIG. 6 shows a cross-sectional view of a lateral production casing installed in the lateral bore of FIG. 5.

In FIG. 4, a packer 32 is set with the lower production casing 9 for protecting the lower production casing while performing the next completion operations. Then, an open-hole whipstock 20 is arranged in the first part 11 of the main bore 10, and then, the drilling head 7 is inserted into the first part of the main bore for drilling a lateral bore 16 extending from the first part of the main bore, as shown in FIG. 5. The lateral bore 16 has an inner lateral bore diameter $D_{i4}$ which is substantially equal or identical to the inner main bore diameter, since the lateral bore 16 is drilled from the main bore 10 and not through the lower production casing. Subsequently, the drilling head 7 is retracted from the lateral bore 16, and a lateral production casing 17 is inserted in the lateral bore, as shown in FIG. 6. The lateral production casing 17 has annular barriers 15 and an inner diameter $D_{i5}$ which is substantially equal to the inner diameter of the lower production casing.

When completing a prior art well having cased laterals, the main production casing is inserted first, and subsequently, the lateral is made by drilling a hole in the main production casing and further out in the formation. Thus, the inner diameter of the main production casing needs to be larger than the inner diameter of the main production casing. When the completion is planned, the lateral diameter defines the minimum inner diameter of the main production casing, as the drilling head must be able to enter through the main production casing. Thus, the main production casing and the main bore need to be larger than in the completion system of the present invention. Therefore, the completion system of the present invention is less expensive to drill and the components are less expensive to manufacture as the main production casing is substantially slimmer and thus less material-demanding to produce. Furthermore, the lateral production casing and the main production casing are mounted from identical components, which minimises the need of spares when assembling the casings. The annular barriers 15 of the lateral production casing 17 are thus identical to the annular barriers of the lower production casing 9, and the lateral part of the completion is thus made of the same components as the main part of the completion, which makes it cheaper to manufacture the production casings, as fewer component variations are required and less spare parts need to be taken into account when calculating the need of components for making the well.

Figure 7:
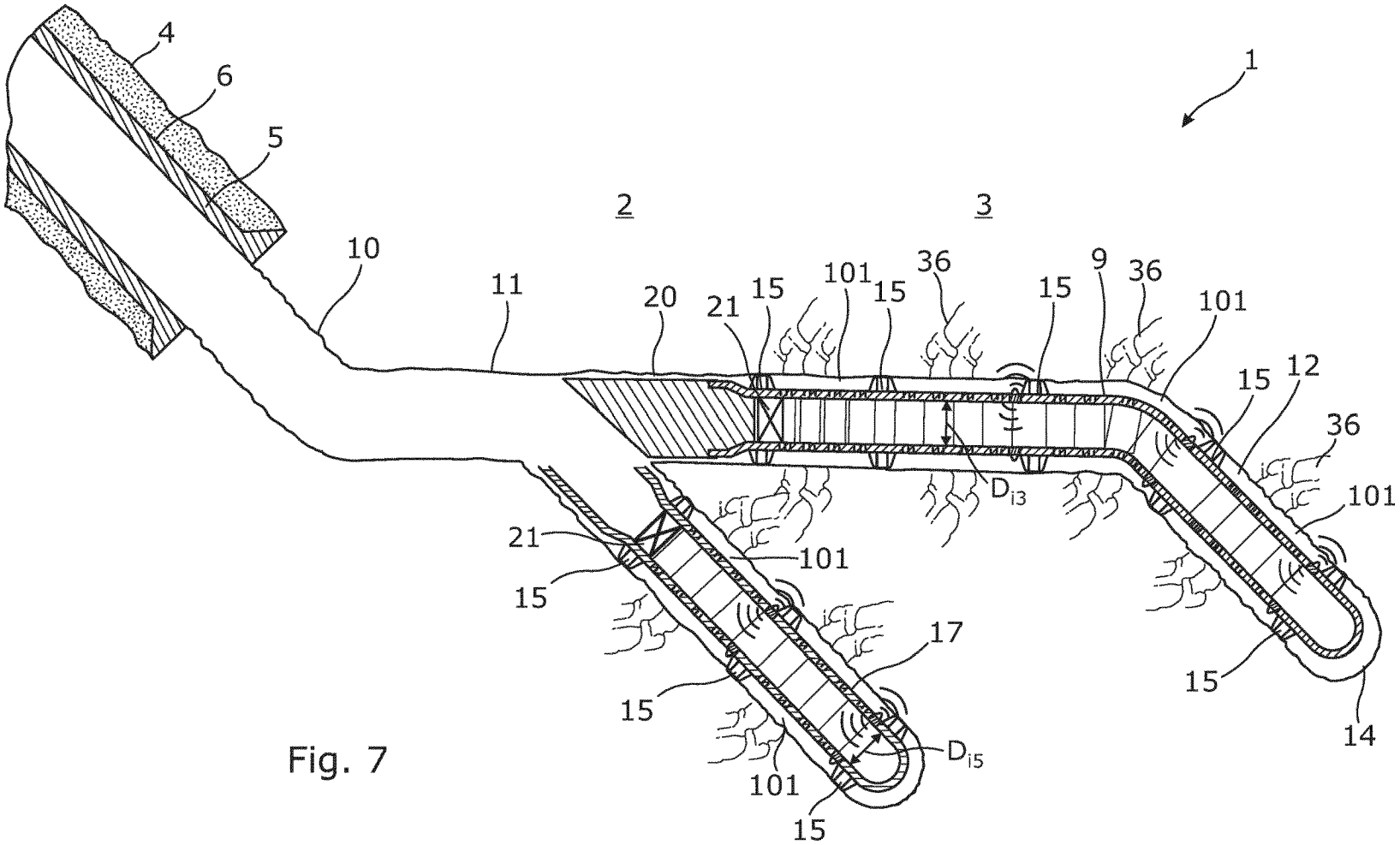
FIG. 7 shows a plug set in the lateral production casing of FIG. 6.
Figure 8:
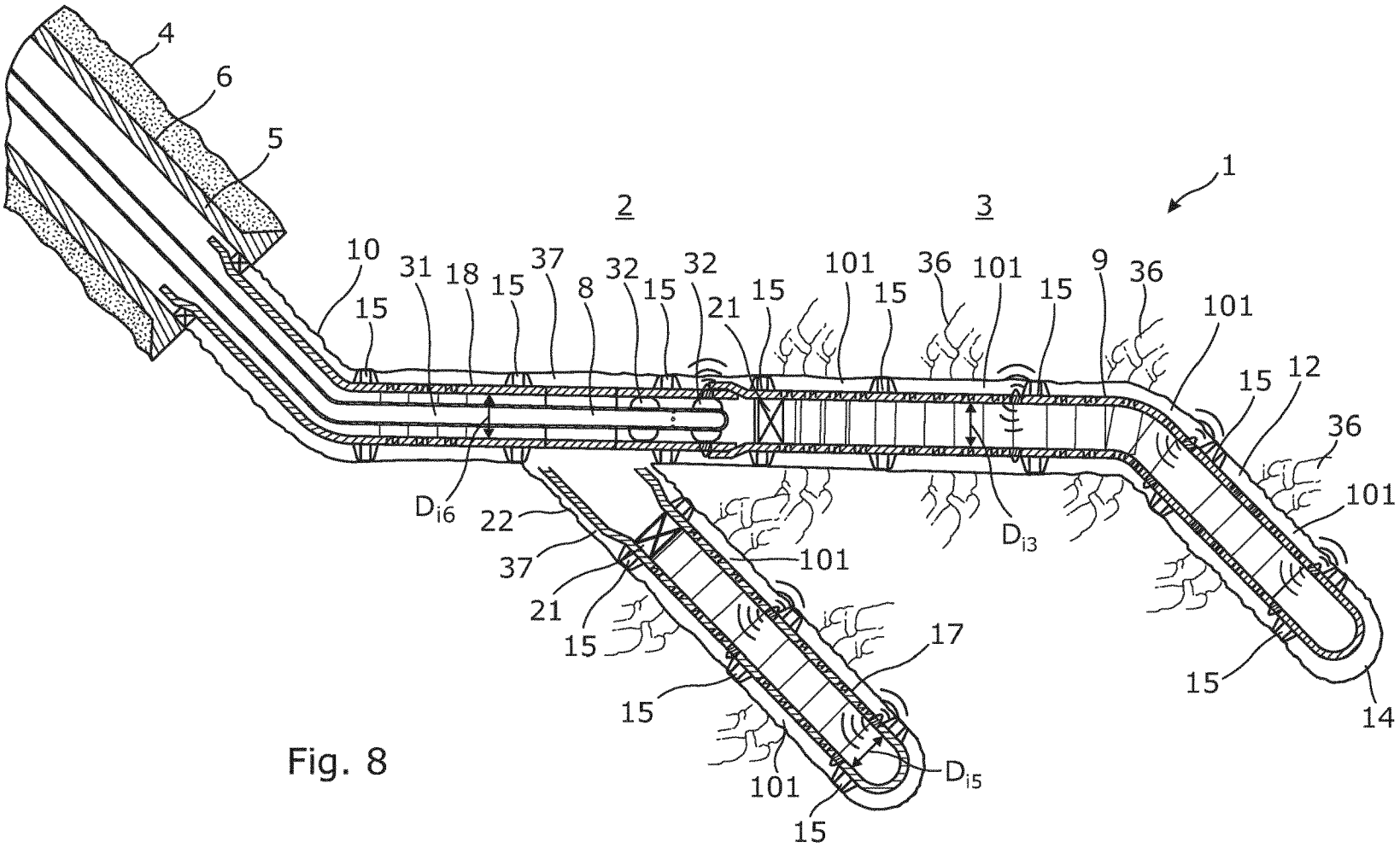
FIG. 8 shows a cross-sectional view of a second main production casing being installed in a first part of the main bore.

When the lateral production casing 17 has been inserted into the lateral bore 16, the annular barriers 15 of the lateral production casing 17 are set, and the formation is fractured opposite the production zones 101, as shown in FIG. 6. Subsequently, as shown in FIG. 7, a plug 21 is set in the top of the lateral production casing 17 in order to protect the lateral production casing in following operations. In FIG. 8, a main production casing 18 is inserted in the first part 11 of the main bore 10. The main production casing 18 has a plurality of annular barriers 15 and an inner diameter $D_{i6}$ which is substantially equal to the inner diameter of the lower production casing 9. Two annular barriers 15 of the main production casing 18 are arranged on opposite sides of the lateral production casing. Then, the annular barriers 15 of the main production casing 18 are set and the two annular barriers 15 on opposite sides of the lateral production casing isolate a transition zone 37 together with the annular barrier and the plug 21 of the lateral production casing. And since there are no fractures in this transition zone, no formation fluid is able to enter the transition zone 37.

As can be seen from the method shown in FIGS. 1-15, the downhole completion system 1 is, after the installation of the surface casing, thus made by building up the completion system from the end of the bores before inserting the next casing part. By making the main production casing with a lower production casing 9 and a main production casing 18, the laterals can be made with the same diameter as the main bore 10 and the lateral production casing with the same inner diameter as the main/lower production casing.

Figure 9:
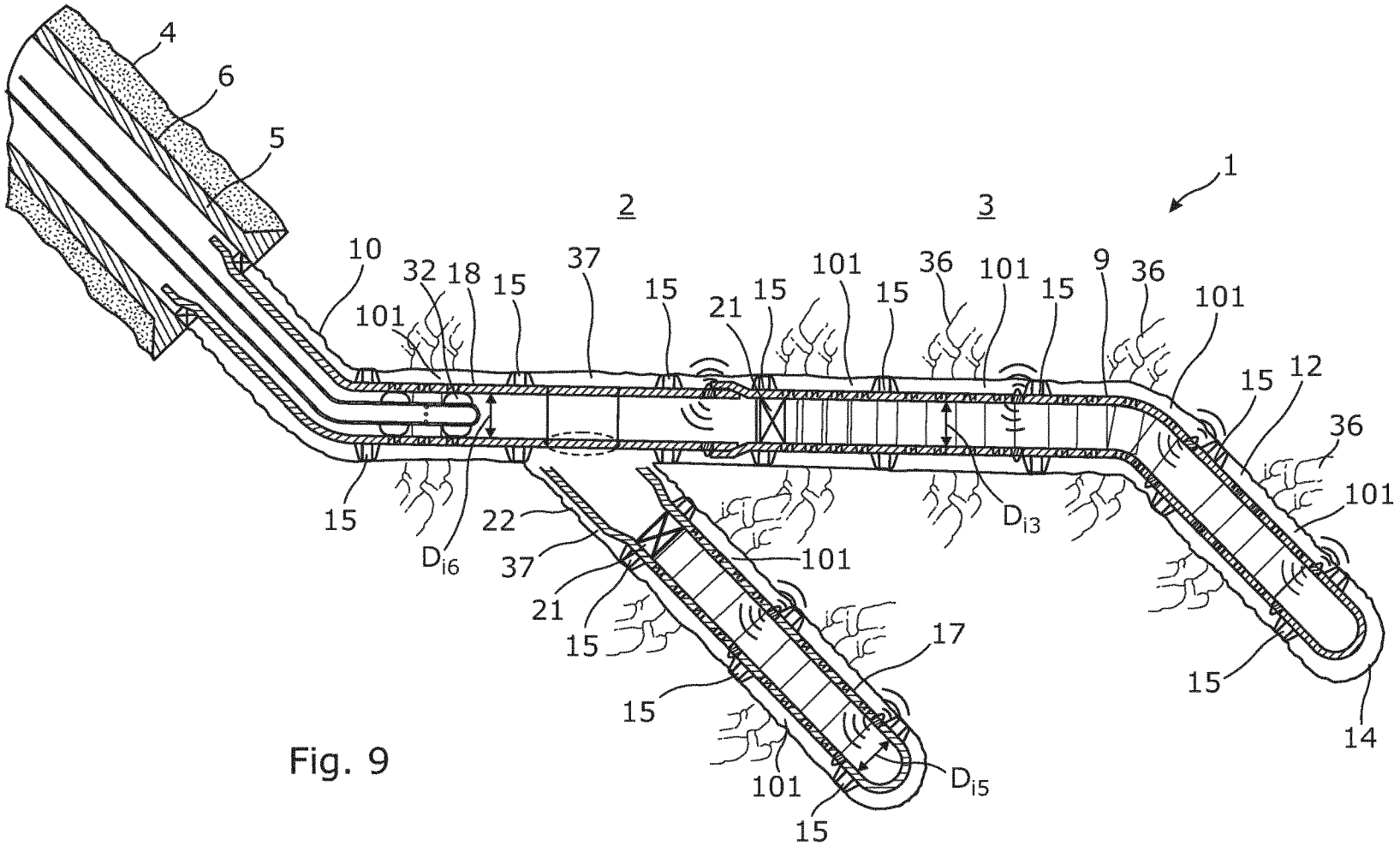
FIG. 9 shows the formation between two annular barriers of the second main production casing being fractured.
Figure 10:
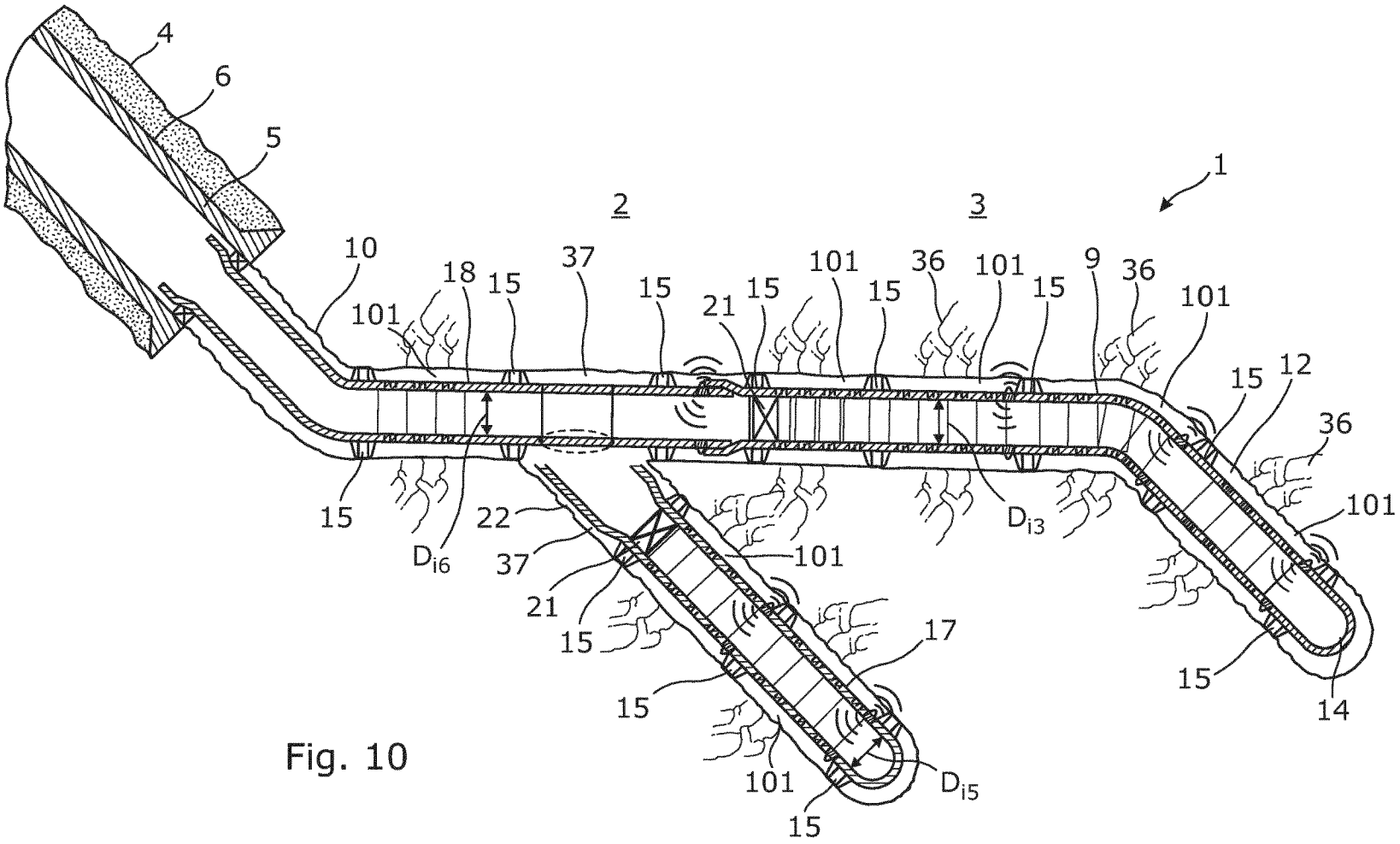
FIG. 10 shows the completion system of FIG. 9, wherein the setting tool has been retracted.
Figure 11:
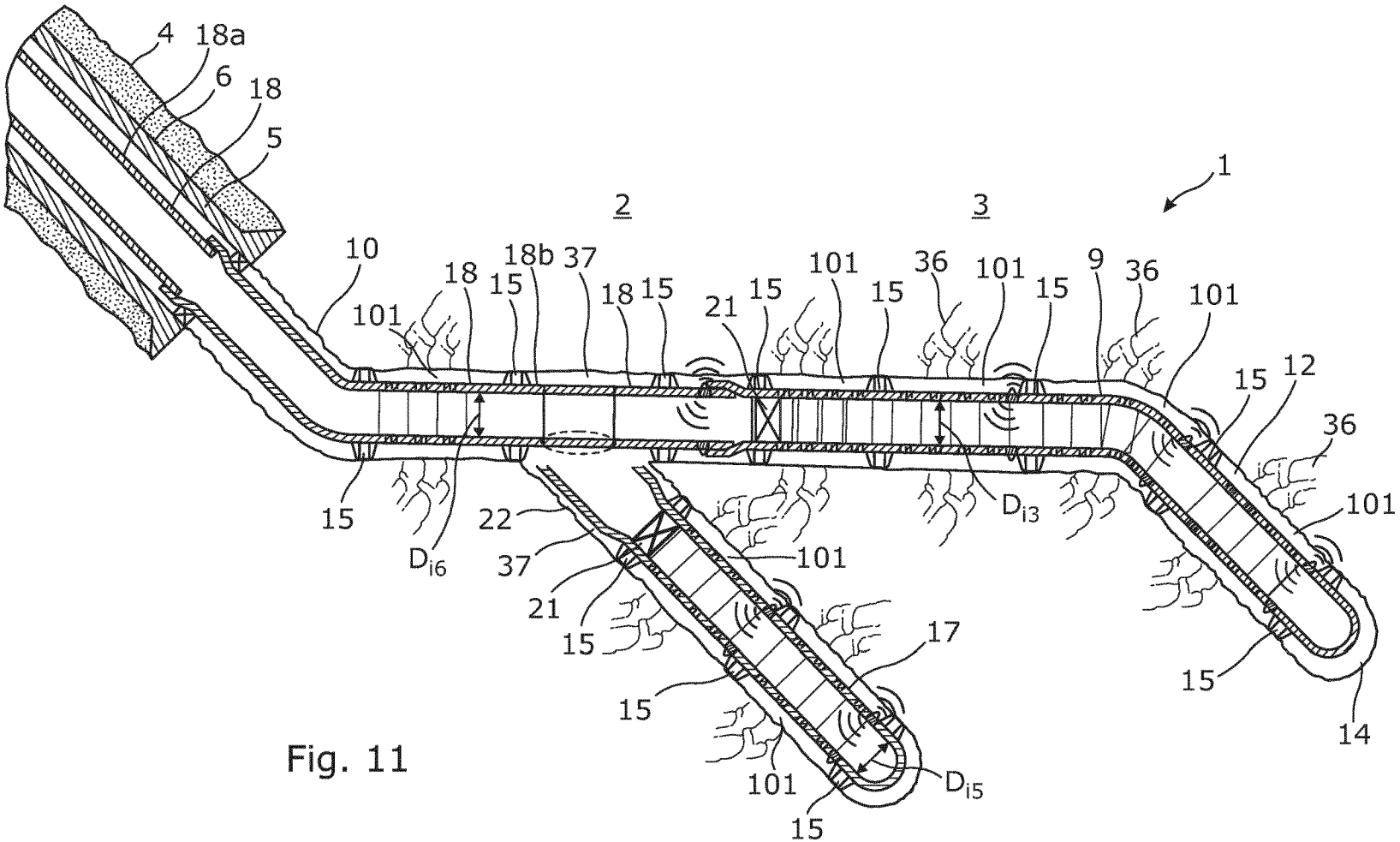
FIG. 11 shows a cross-sectional view of a first main production casing installed in the surface casing and connected with the second main production casing.

In FIG. 9, the production zones 101 are fractured, but the transition zone 37 is not, and the tool 8 is retracted from the completion system 1, as shown in FIG. 10. In FIGS. 11-15, the main production casing 18 is formed by a first main production casing 18*a* and a second main production casing 18*b*. The second main production 18*b* casing is arranged in the first part 11 of the main bore 10 between the lower production casing 9 and the first main production casing 18*a*. The first main production casing 18*a* and the second main production casing 18*b* are fastened to each other, e.g. by a sealing means arranged around the first main production casing 18*a*, engaging the outer face of the second main production casing 18*b*.

Figure 12:
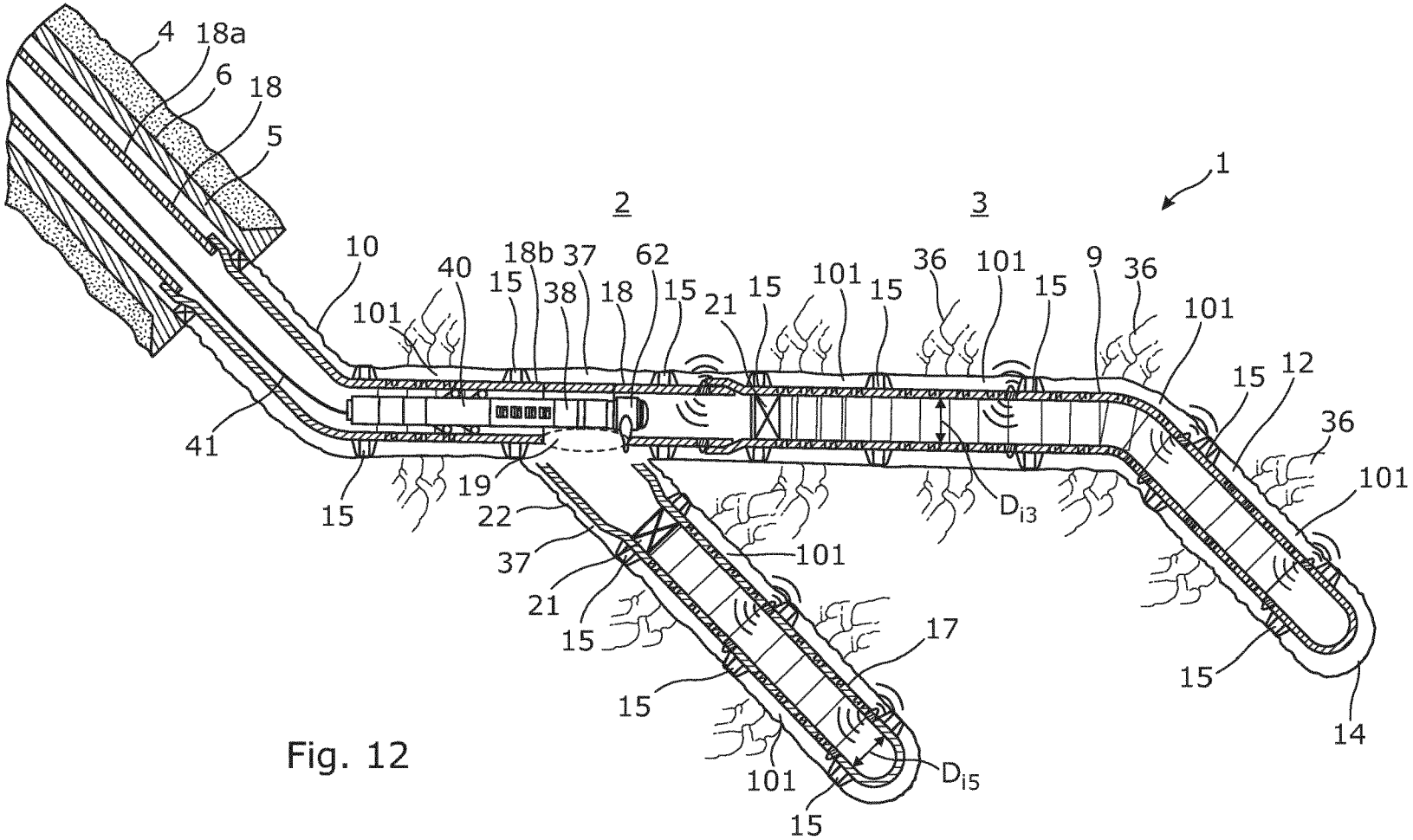
FIG. 12 shows a cross-sectional view of the completion system of FIG. 11 where a cutting tool is making an opening in the second main production casing opposite the lateral production casing.

Before removing the plugs 21, an opening 19 is provided in the main production casing 18 opposite the lateral production casing 17, fluidly connecting the lateral production casing with the main production casing. In FIG. 12, the opening 19 in the main production casing 18 is provided by a cutting tool 38 having a cutting head movable in three directions, i.e. along the axial axis of the tool, rotatable around the axial axis and radially outwards towards the casing. The tool 38 further comprises a driving unit 40, such as a downhole tractor, which is powered through a wireline 41. The drilling head 7 thus drills an oval opening 19, as indicated by the dotted line.

Figure 13:
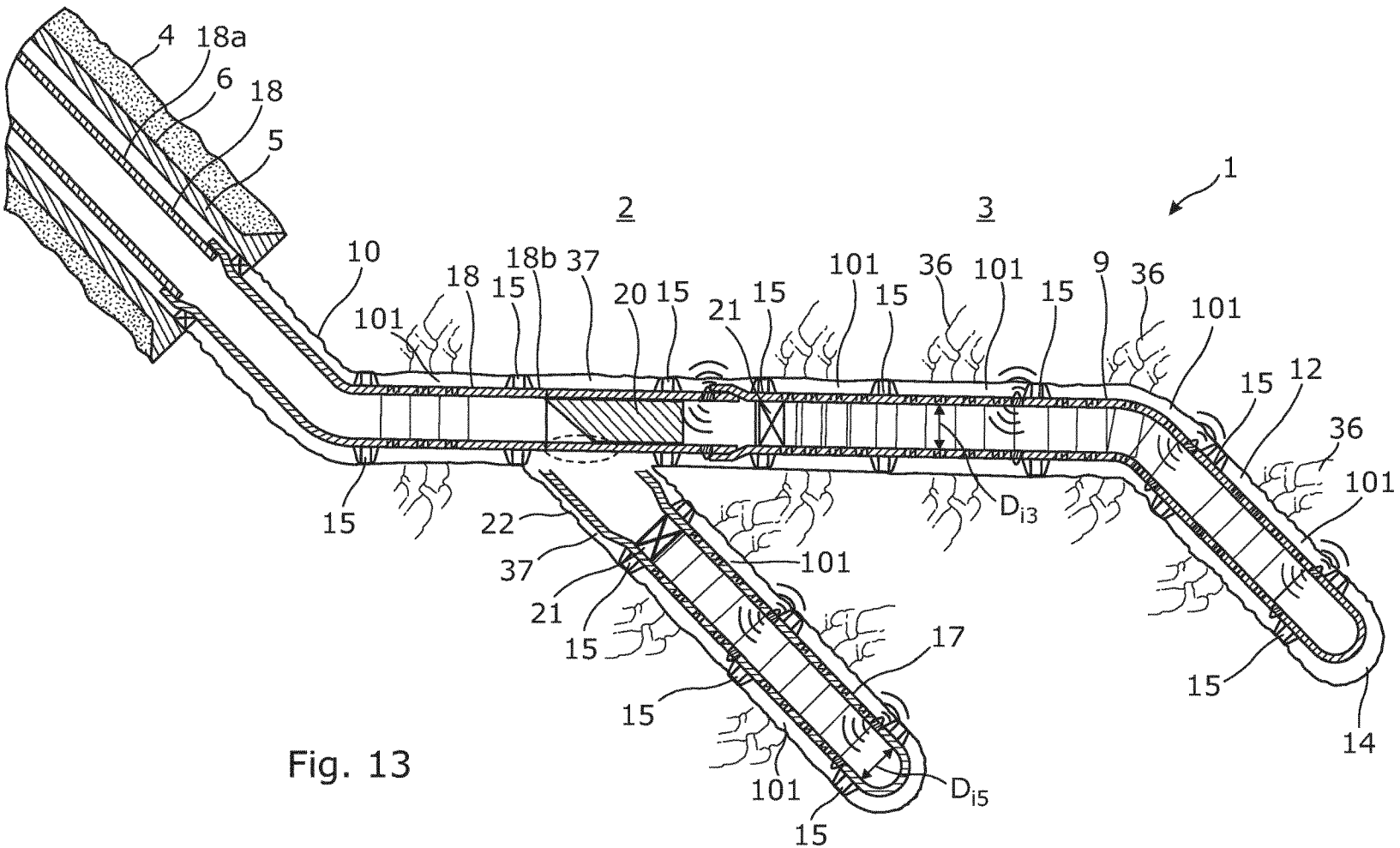
FIG. 13 shows a cross-sectional view of the completion system of FIG. 11 where a casing whipstock is arranged in the second main production casing.
Figure 14:
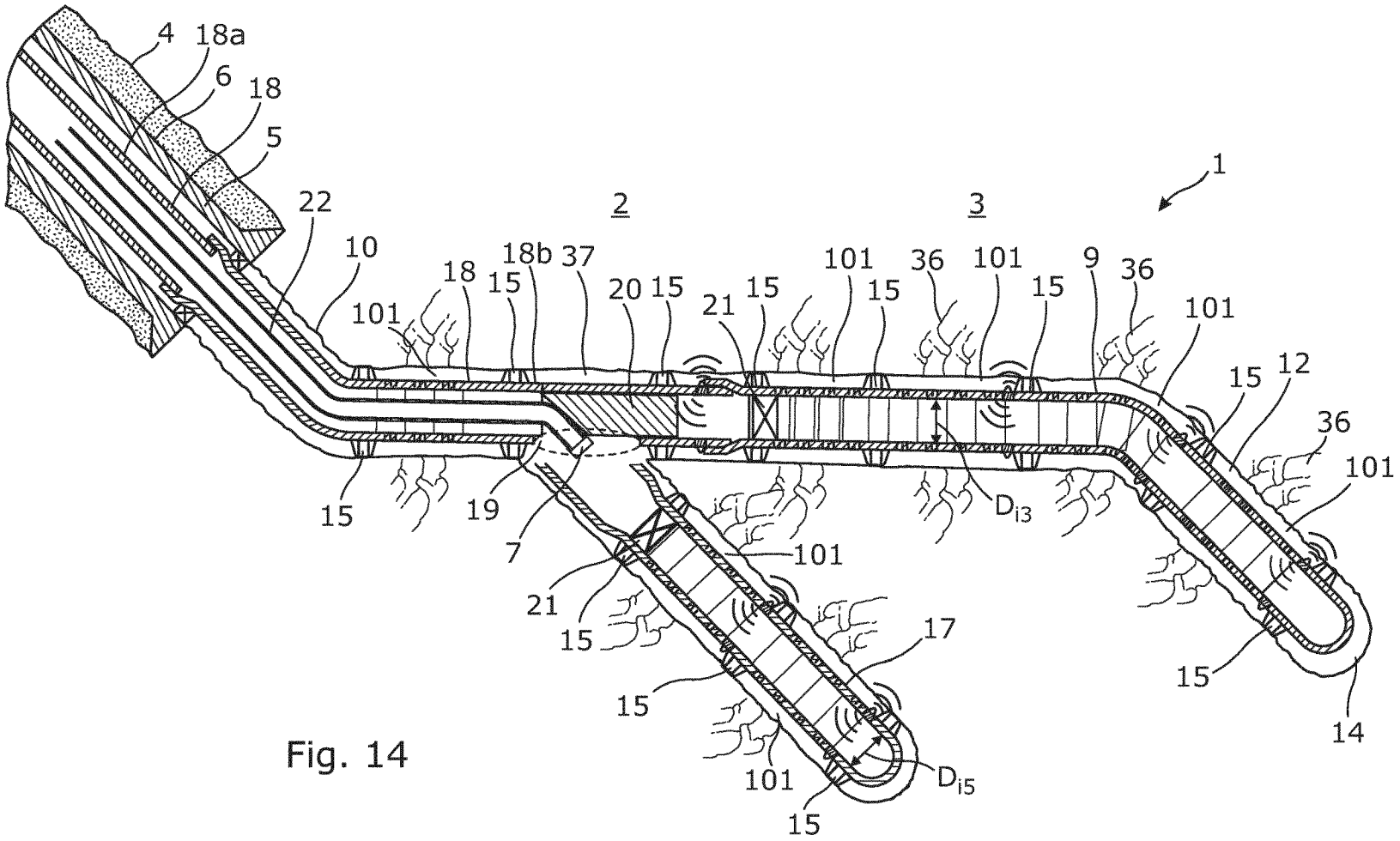
FIG. 14 shows a cross-sectional view of the completion system of FIG. 14 where a drilling head is drilling an opening in the second main production casing opposite the lateral production casing.

Another way of providing the opening 19 in the main production casing 18 is shown in FIG. 13 where a whipstock 20 being a casing whipstock is arranged in the main production casing 18, and subsequently, a drilling head 7 on a drill pipe 22 is guided along the whipstock, drilling the opening 19 in a more conventional manner, as shown in FIG. 14.

Figure 15:
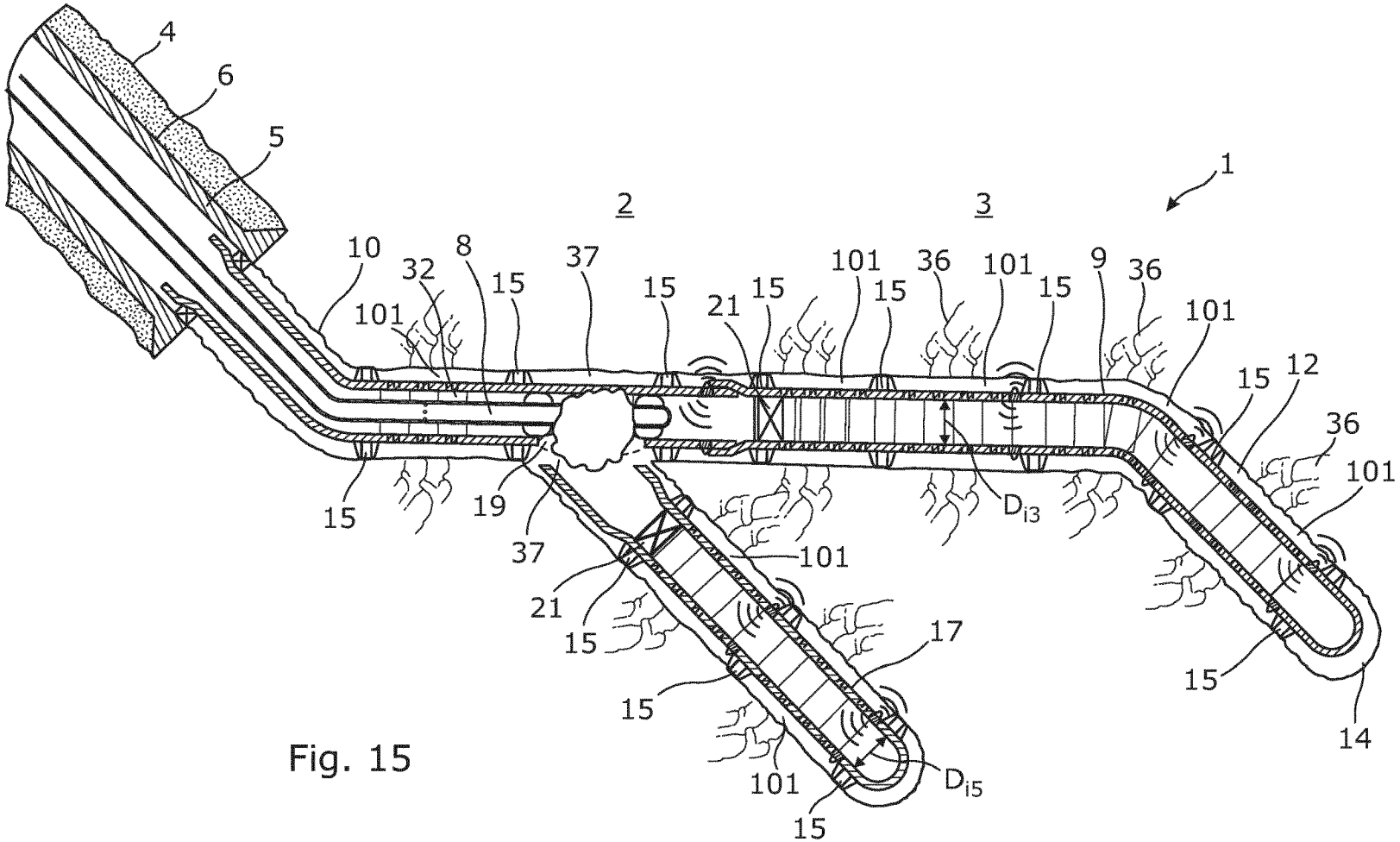
FIG. 15 shows a cross-sectional view of the completion system of FIG. 11 where acid is used to make an opening in the second main production casing opposite the lateral production casing.

In FIG. 15, the opening 19 in the main production casing 18 is provided by acid injected from the tool 8 which may also be used for fracturing and expanding the annular barriers 15 locally. The main production casing 18 has a transition area opposite the transition zone 37, which area is made of aluminium or aluminium alloy which is removable by acid. The opening 19 is provided by removing the aluminium by dissolving the aluminium by means of the injected acid.

When the opening 19 is provided and the plugs 21 removed, the downhole completion system 1 is open for production of hydrocarbon-containing fluid from the reservoir.

Figure 18:
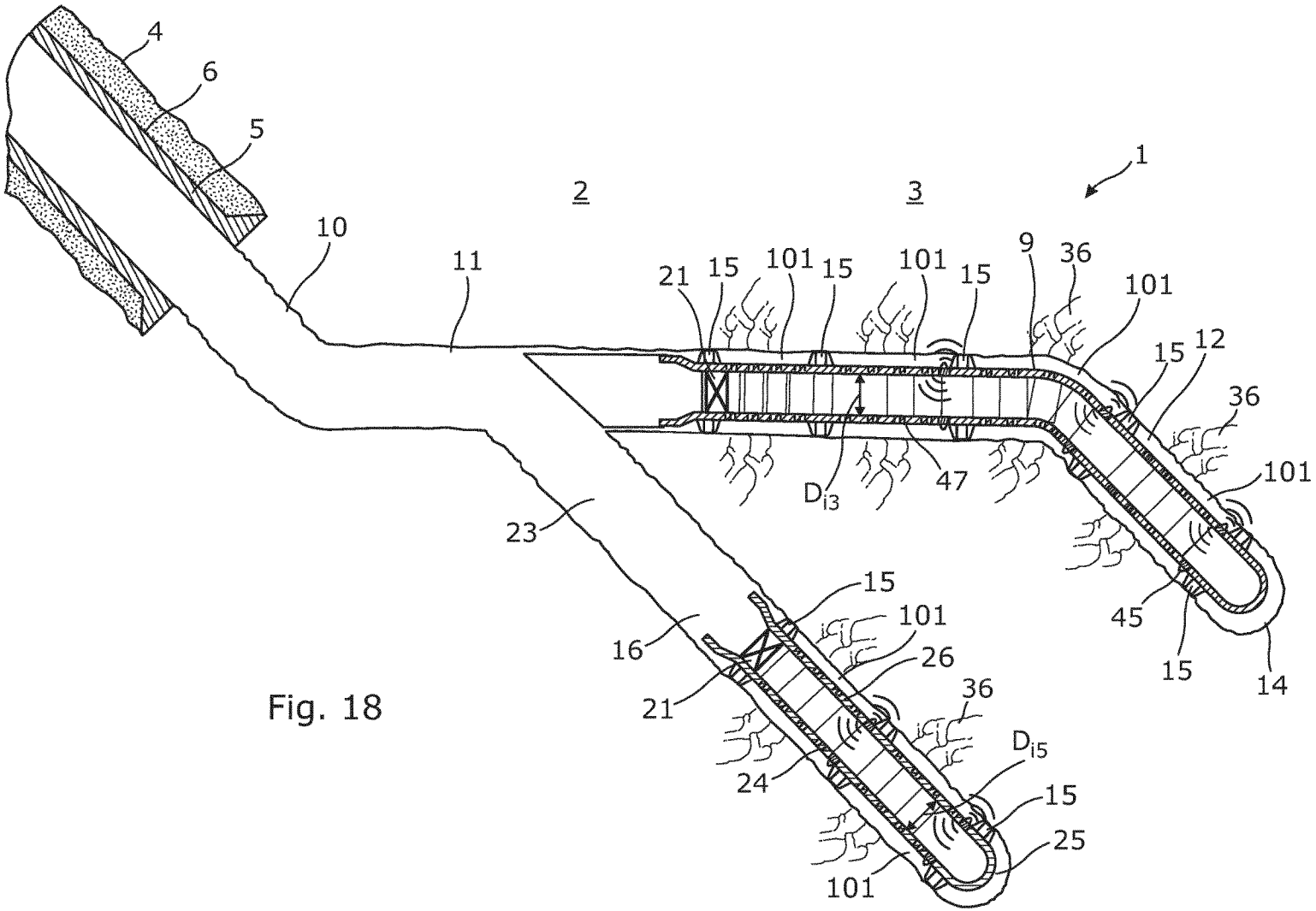
FIG. 18 shows a cross-sectional view of a lower lateral production casing installed in the second part of the lateral bore.

The downhole completion system 1 may also be made with laterals which are referred to as sub laterals in the following. When this is the case, the lower production casing 9 is installed in the second part 12 of the main bore 10, as previously described, and subsequently, the lateral is drilled with a first part 23 and a second part 24, the second part comprising the end 25 of the lateral, as shown in FIG. 16. Subsequently, a lower lateral production casing 26 is installed in the second part 24 of the lateral bore 16, as shown in FIG. 18, and the annular barriers 15 are expanded, thereby isolating the production zones 101, which zones are then fractured, and a plug 21 is set in the top of the lower lateral production casing 26.

Figure 19:
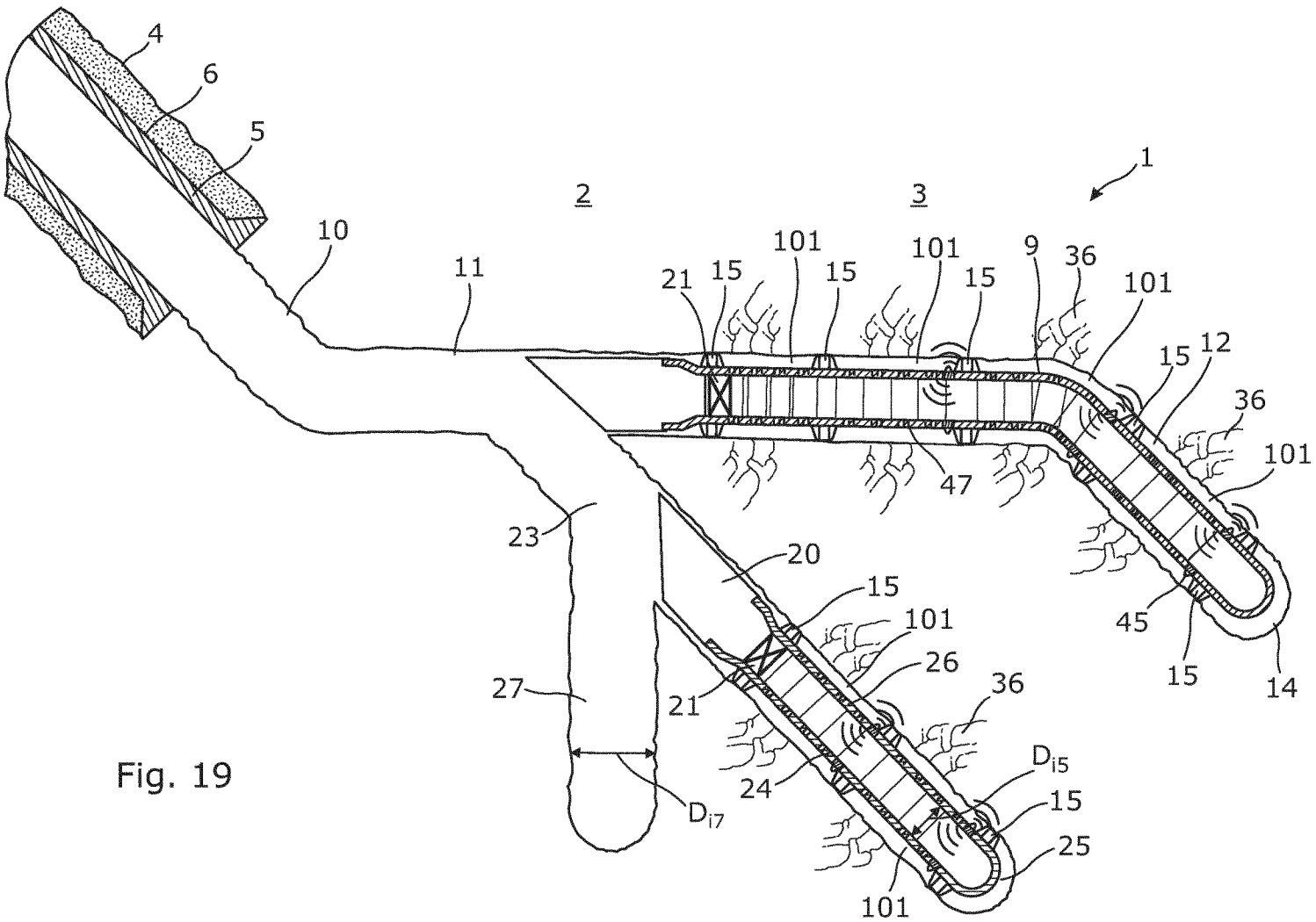
FIG. 19 shows a cross-sectional view of a sub lateral bore which has been drilled.

As shown in FIG. 19, an openhole whipstock 20 is then arranged in the first part 23 of the lateral bore 16 above the plug 21, closing the lower lateral production casing 26. Subsequently, the drilling head 7 is inserted for drilling a sub lateral bore 27 extending from the first part 23 of the lateral bore 16. The sub lateral bore 27 has an inner sub lateral bore diameter $D_{i7}$ which is substantially equal to the inner main bore diameter.

Figure 20:
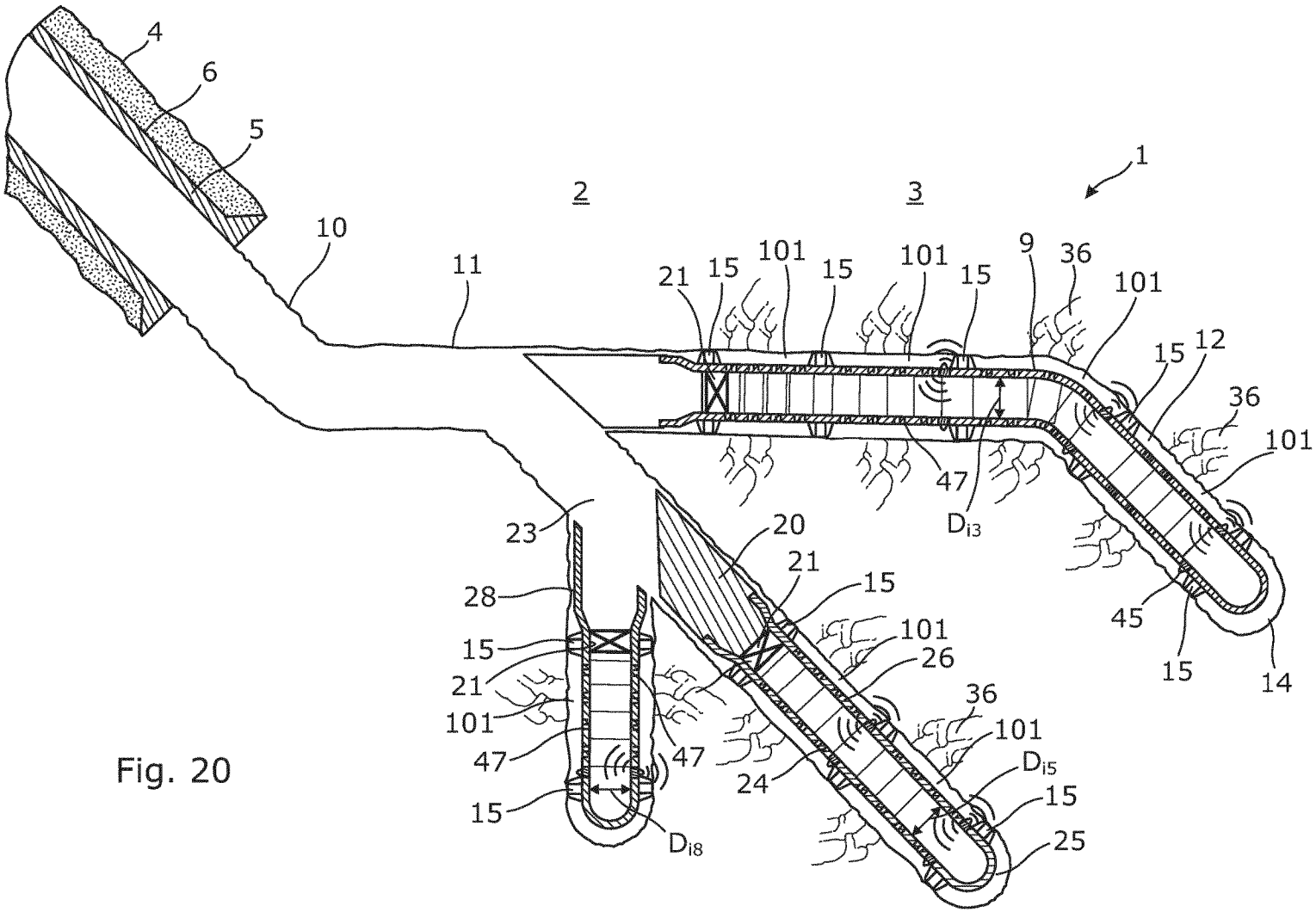
FIG. 20 shows a cross-sectional view of a sub lateral production casing installed in the sub lateral bore.

In FIG. 20, a sub lateral production casing 28 is inserted in the sub lateral bore 27. The sub lateral production casing 28 comprises annular barriers 15 which are subsequently set, and the formation is fractured through frac ports 47. Subsequently, a plug 21 is set in the top of the sub lateral production casing 28.

Figure 21:
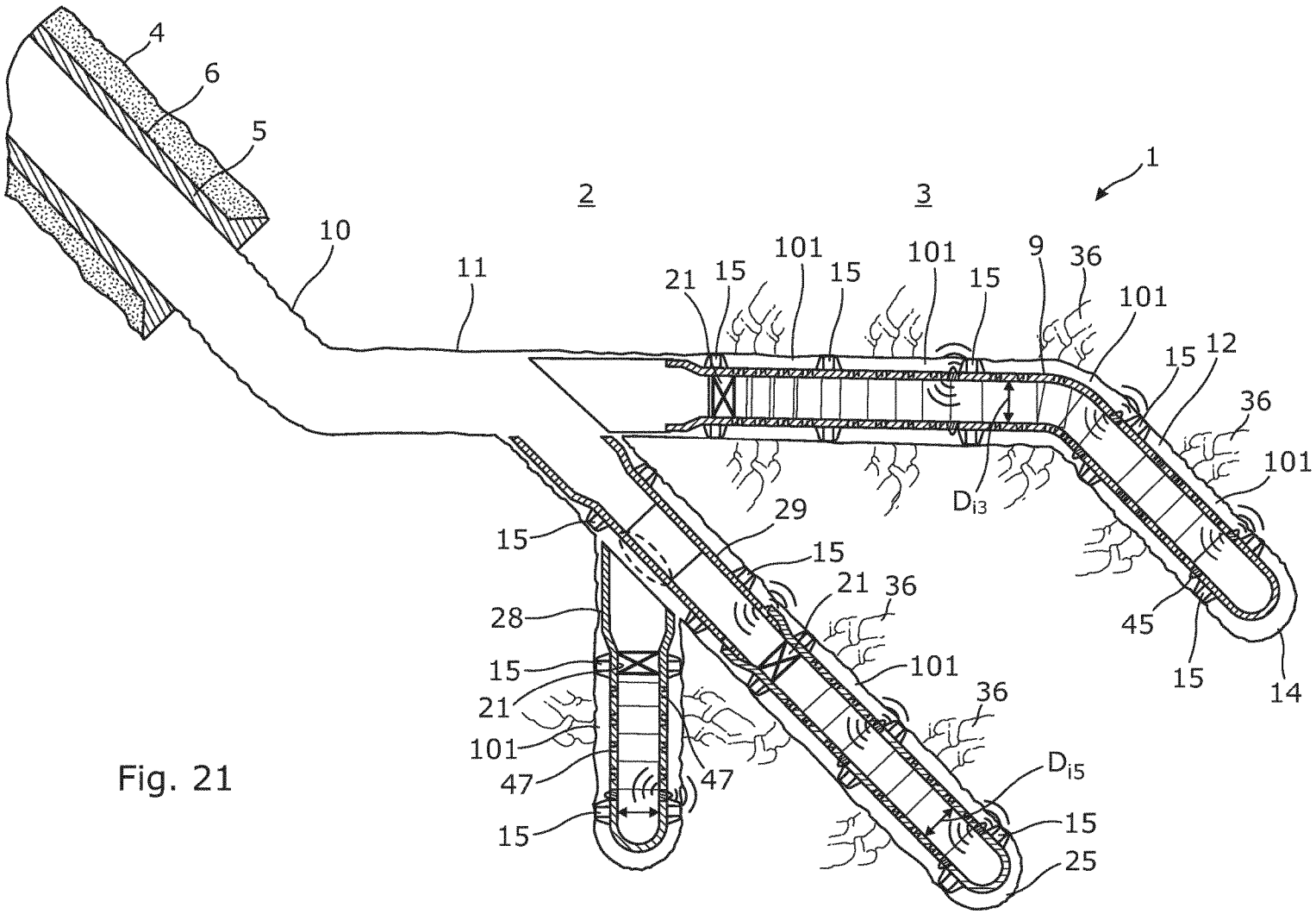
FIG. 21 shows a cross-sectional view of a second lateral production casing installed in the first part of the lateral bore.
Figure 22:
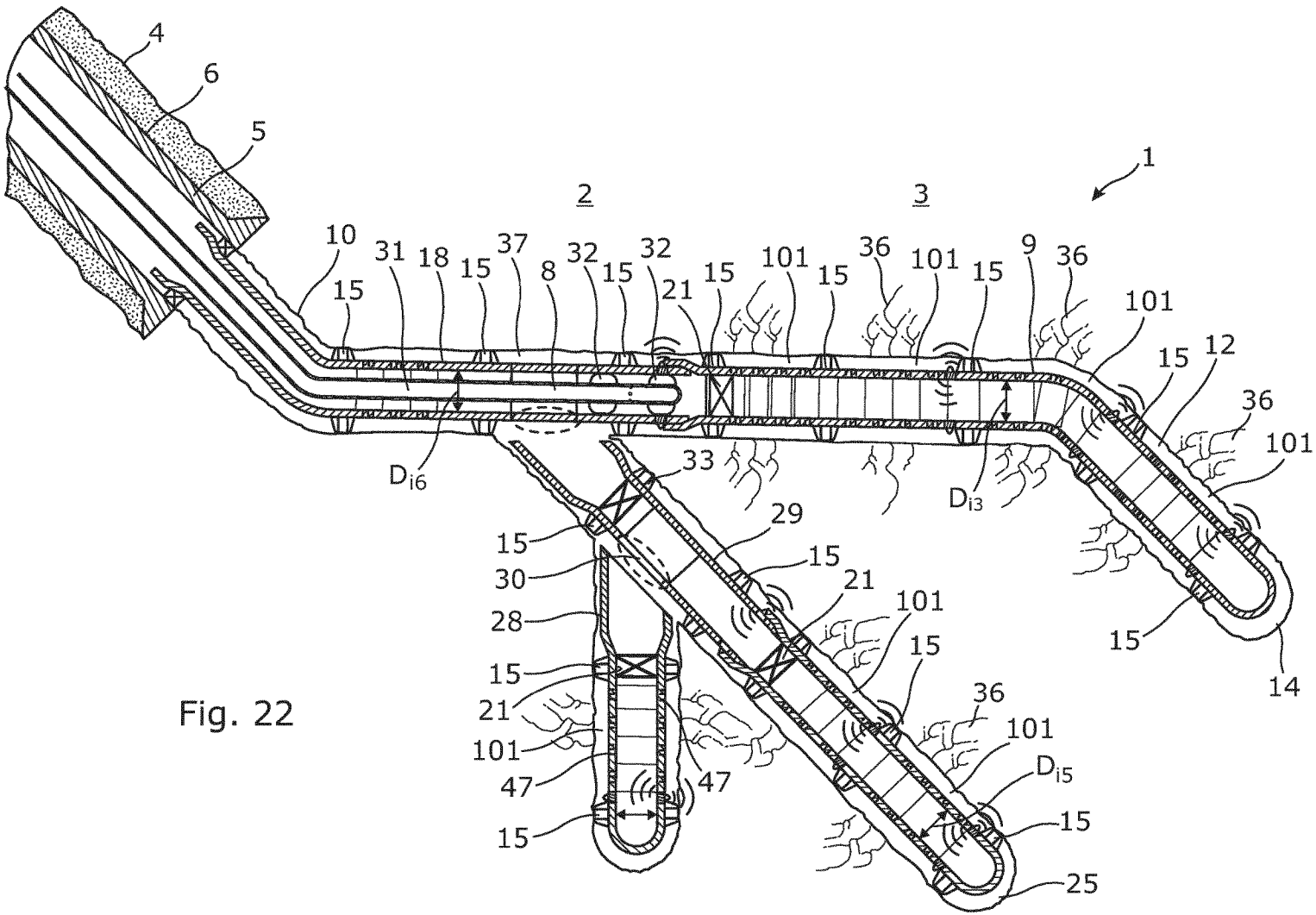
FIG. 22 shows a cross-sectional view of the second main production casing being installed in a first part of the main bore.

The sub lateral production casing 28 is thus closed, and a second lateral production casing 29 is inserted in the first part 23 of the lateral bore 16, as shown in FIG. 21. Then, an opening 30 is provided in the second lateral production casing 29, as shown in FIG. 22, to provide fluid communication between the lateral production casing and the sub lateral production casing. Subsequently, the second main production casing 18*b* is arranged in the first part 11 of the main bore 10 by a setting tool 8 or isolation tool 8, and the annular barriers 15 are set in the second main production casing 18*b*, and the formation is fractured. Finally, the first main production casing 18*a* is inserted and connected with the second main production casing 18*b*.

Figure 23:
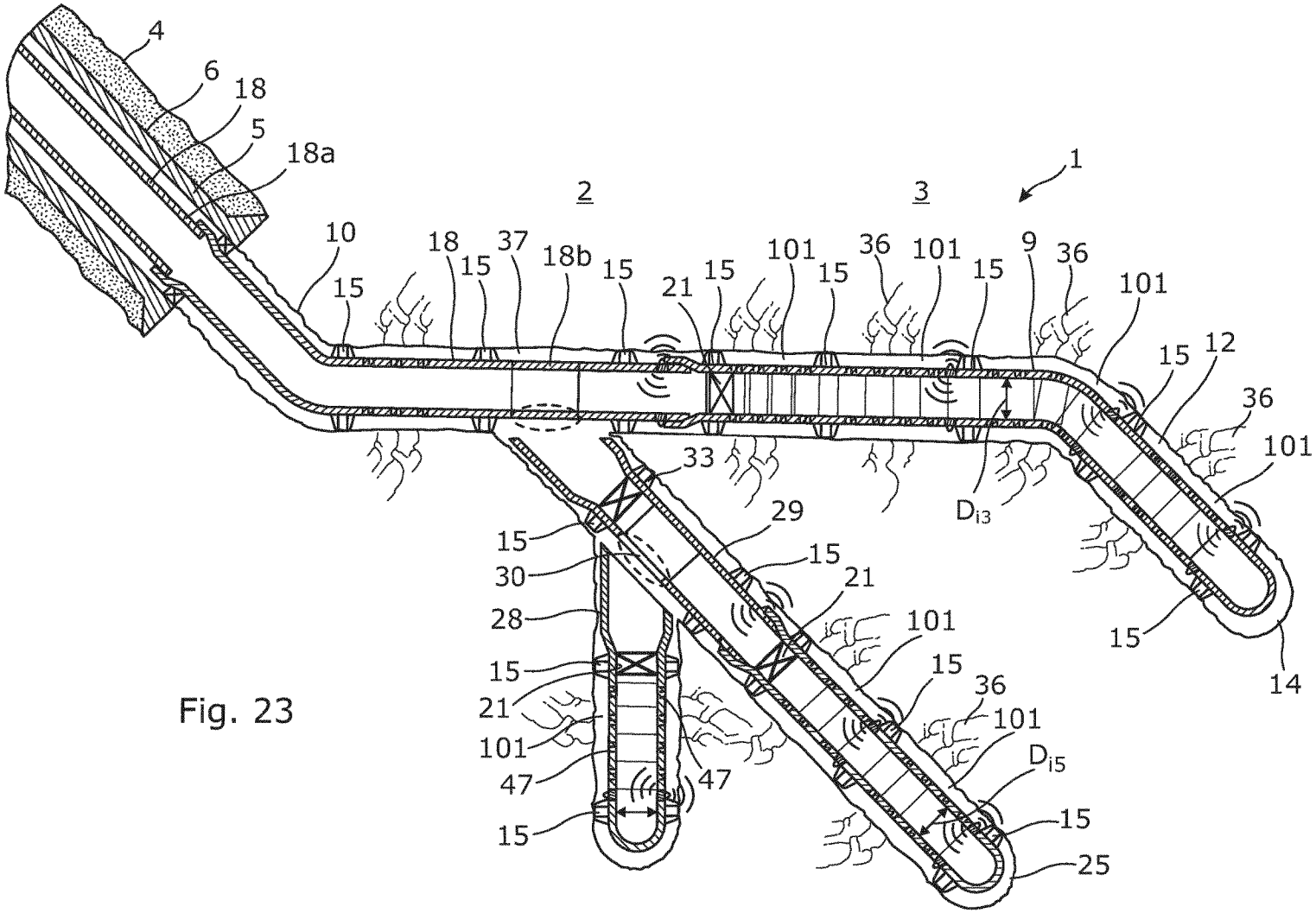
FIG. 23 shows a cross-sectional view of the first main production casing installed in the surface casing and connected with the second main production casing.

FIG. 23 shows a cross-sectional view of the first main production casing installed in the surface casing and connected with the second main production casing.

Access to the sub lateral production casing has not yet been established as the internal packer has not been removed yet.

The completion method may comprise further steps of providing one or more lateral bores, one or more sub lateral bores, one or more secondary sub lateral bores, etc. with production casings, which steps are performed before the step of inserting a main production casing in the first part of the main bore. The completion method may further comprise the step of mounting the production casings from a plurality of components 33, such as annular barriers, inflow control devices 46, sensors 45 and blank casing parts, having equal inner diameters. The annular barriers 15 may be metal annular barriers, swellable packers, elastomeric packers or similar suitable barriers.

Each annular barrier may comprise a tubular part mounted as part of the casing, and a metal expandable sleeve surrounding the tubular part with an opening through which fluid enters to expand the sleeve, the main casing being fluidly connected with the well control means.

As shown in FIG. 16, both the lateral production casing and the main production casing 18 comprise an inflow control device 46, thereby enabling production from the main production casing as well as the lateral production casing. The inflow control device 46 is volume-adjustable, making it possible to adjust the flow from each production zone to optimise the flow of hydrocarbon-containing fluid and to make the well self-producing while the reservoir is emptied synchronously from several positions. If the hydrocarbon-containing fluid is very "heavy", it may be necessary to mix it with more water-containing fluid from another zone in order for the well to be self-producing. Furthermore, the pressure in one production zone may be higher than in another zone, and the inflow control devices 46 thus need to be adjusted to ensure that the reservoir is emptied in an optimal manner to prevent surrounding water from breaking through.

In some production zones, a plurality of inflow control devices are arranged between two adjacent annular barriers 15, as shown in FIG. 16, so that if required, more fluid can flow in through such production zones. If there is no longer a need for a high amount of fluid flowing from these zones, some of the inflow control devices can easily be closed again, e.g. by means of an intervention by a downhole tool.

As shown in FIG. 16, the sensors 45 may be arranged in the walls of the casings and/or the connection parts with a mutual distance between them. The sensors 45 may measure continuously and at intervals of e.g. one month. The sensors 45 may be selected from a group consisting of laser sensors, capacitance sensors, ultrasound sensors, position sensors, flow sensors and other sensors for measuring physical parameters in a downhole environment. The sensors 45 may also be electromagnetic seismic micro sensors, micro magnetic sensors or differential pressure sensors. Furthermore, the sensors 45 may be recharged inductively by the tool 8.

Sensors 45 may drift over time and become imprecise in their measurements. However, by inserting the downhole tool in the well, the sensor 45 can be calibrated by the tool, or measurements performed by the tool may be used to adjust the measurements obtained by the sensors to show what the measurement of a certain sensor at a certain time should have shown. These more precise measurements are thus used in the later data processing for adjusting the measurements of the drifted sensor.

Furthermore, data from the sensor 45 may be downloaded so that the development of the reservoir can be determined. The downhole tool may thus comprise an induction unit capable of loading a battery of the sensor 45 and downloading data from the sensor and emptying the memory of the sensor before proceeding to the next sensor. Each sensor 45 may have a battery, a memory and a communication unit so that the sensor can communicate data to an adjacent sensor further up the well to the top. The downhole tool may have means for recharging the battery as the tool intervenes the well. The tool itself is submerged through a wireline, but may also be powered by a battery. The tool is submerged through a blow-out-preventer (BOP) and/or a wellhead arranged in the top of the well. In subsea wells, the flow control means may further comprise a lubricator.

Figure 24:
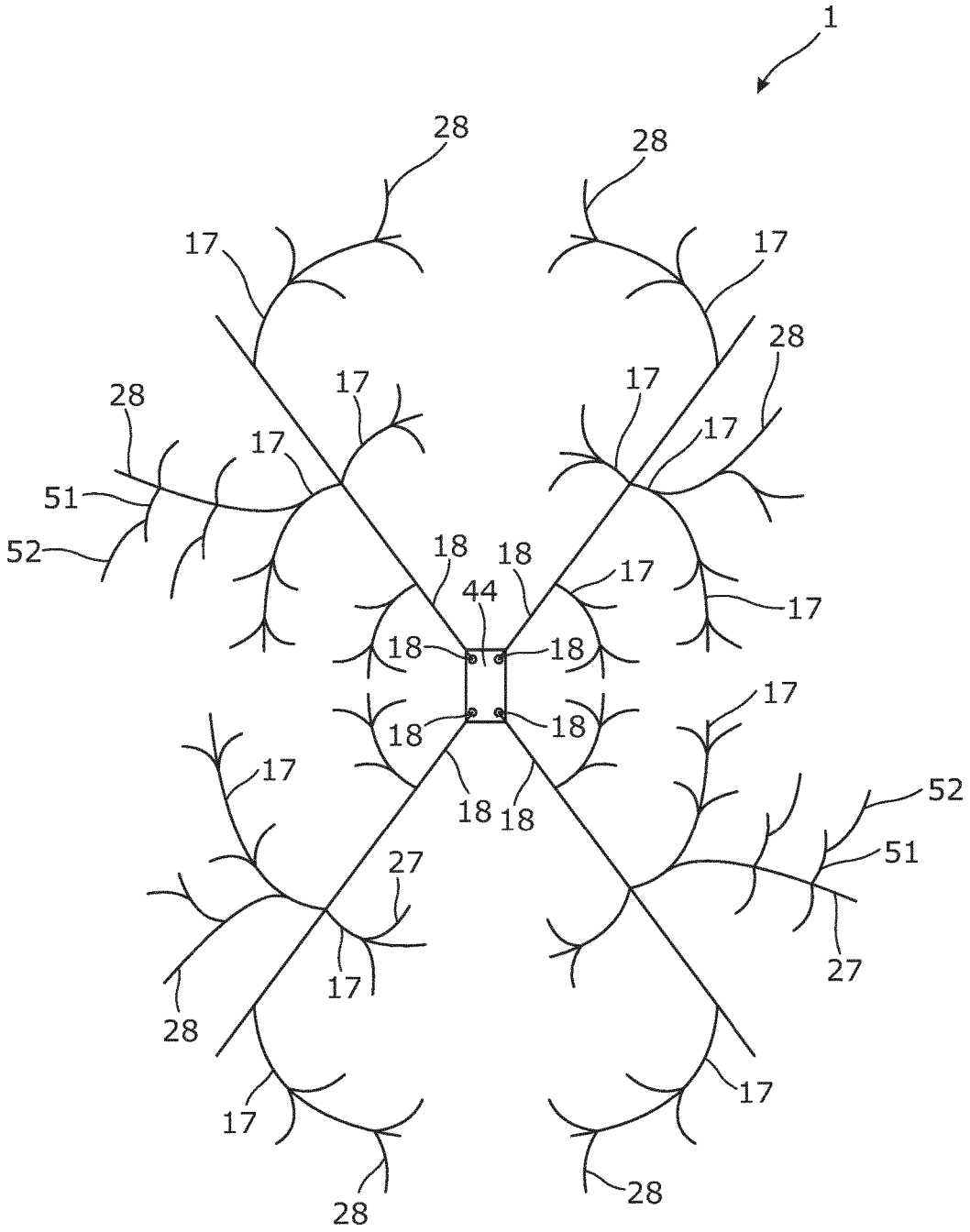
FIG. 24 shows an illustration of a downhole completion system having several main casings supported by the base structure and seen from above.

The downhole completion system 1 may comprise a plurality of main production casings 18 fluidly connected with well control means supported on a base structure 44, as shown in FIG. 24. The base structure 44 may be a frame structure supported on the ground or the seabed and supporting a control means, such as a well head or a blowout preventer. The base structure 44 may comprise a cemented platform arranged underneath the control means. By being able to make lateral production casings capable of isolating certain production zones, a very large reservoir area can be reached from only one base structure. And since the base structure 44 is one of the very costly parts involved in completing a well, a lot of money is saved by having a lateral production casing with annular barriers. As shown, the sub lateral production casing 28 comprises a secondary lateral production casing arranged between the first and second lateral annular barriers. Furthermore, the secondary sub lateral production casing comprises first and second secondary lateral annular barriers (not shown). The secondary sub lateral production casing comprises inflow control devices for controlling the amount of fluid allowed to flow from the production zones into the main production casing 18.

As shown in FIG. 24, the secondary sub lateral production casing may further be connected with a tertiary sub lateral production casing 51 arranged between the first and second secondary sub lateral annular barriers. The tertiary sub lateral production casing 51 of the system may further comprise a fourth sub lateral production casing 52, and the fourth sub lateral production casing may comprise a fifth sub lateral production casing, and so on.

Figure 25:
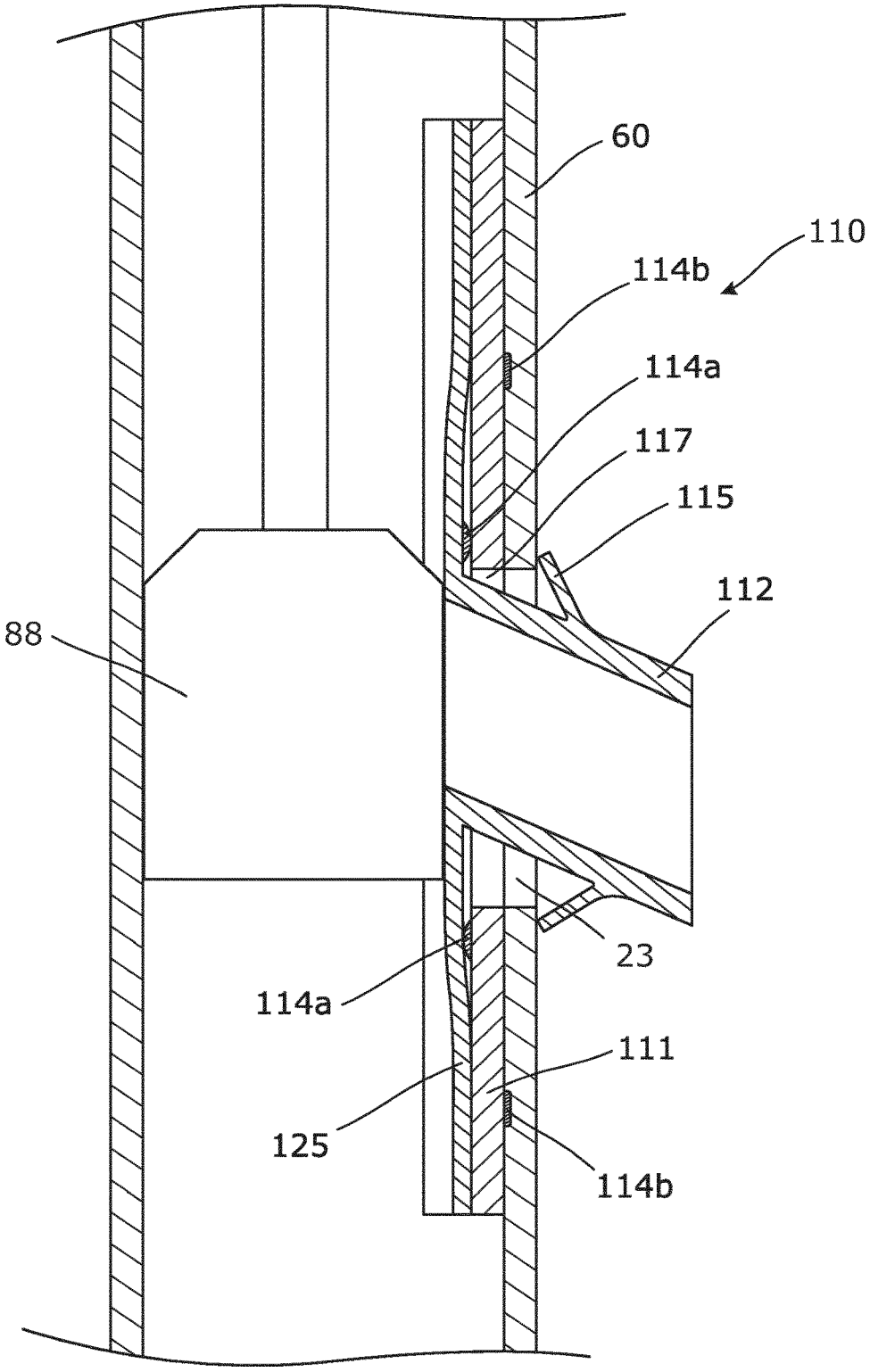
FIG. 25 shows a connection part in the form of a lateral junction.

By being able to isolate zones in the lateral production casing, it becomes safer to incorporate the laterals in the completion, and the openings in the main production casing 18 can thus be made larger as the risk is reduced. Thus, being able to make larger openings for the laterals also makes it possible to make laterals which can be intervened by a downhole tool, and this opens up the possibility of being able to design the completion when the well has been producing for some time. More laterals can be made and inflow control devices 46 can be adjusted according to the information received from the sensors 45. As shown in FIG. 16, the casings may, in connection with the inflow control devices 46, comprise frac ports 47 so that pressurised fluid can be injected into the formation for fracturing the formation and gaining more reservoir contact. In FIG. 25, a connection part in the form of a lateral junction assembly 110 is shown. The connection part is inserted and installed by a tool prior to the insertion of the side track casing but after the drilling of the side track borehole. The lateral junction assembly 110 of FIG. 10 comprises a flange 111 extending in a longitudinal direction and being curved in a transverse direction and a pipe section 112 for being inserted through the opening 117 in the flange 111. On an outer surface 131 of the flange 111, a sealing material **114*b* may be arranged around the opening 117 for providing a sealing effect between the flange 111 and an inner surface of the casing. The lateral junction assembly 100 further comprises a fixation element 125 extending from the pipe section 112 and acting to force the pipe section 112 through the opening 117 in the flange 111. The fixation element 125 may be a sheet of spring steal, one or more spring members, e.g. in the form of strands, or other flexible means capable of exerting a pushing force on an end of the pipe section when in a deactivated position. Before being installed in a casing downhole, the pipe section 112 is kept in position by one or more activation members, preventing the pipe section 112 from being pushed through the opening 117**. The activation members are distance rods maintaining a certain distance between the pipe section and the opening through which it is to enter when fastening to the casing to form a lateral. The activation members may also be a second pipe section surrounding the lateral assembly, preventing the pipe section from entering the opening.

Figure 26:
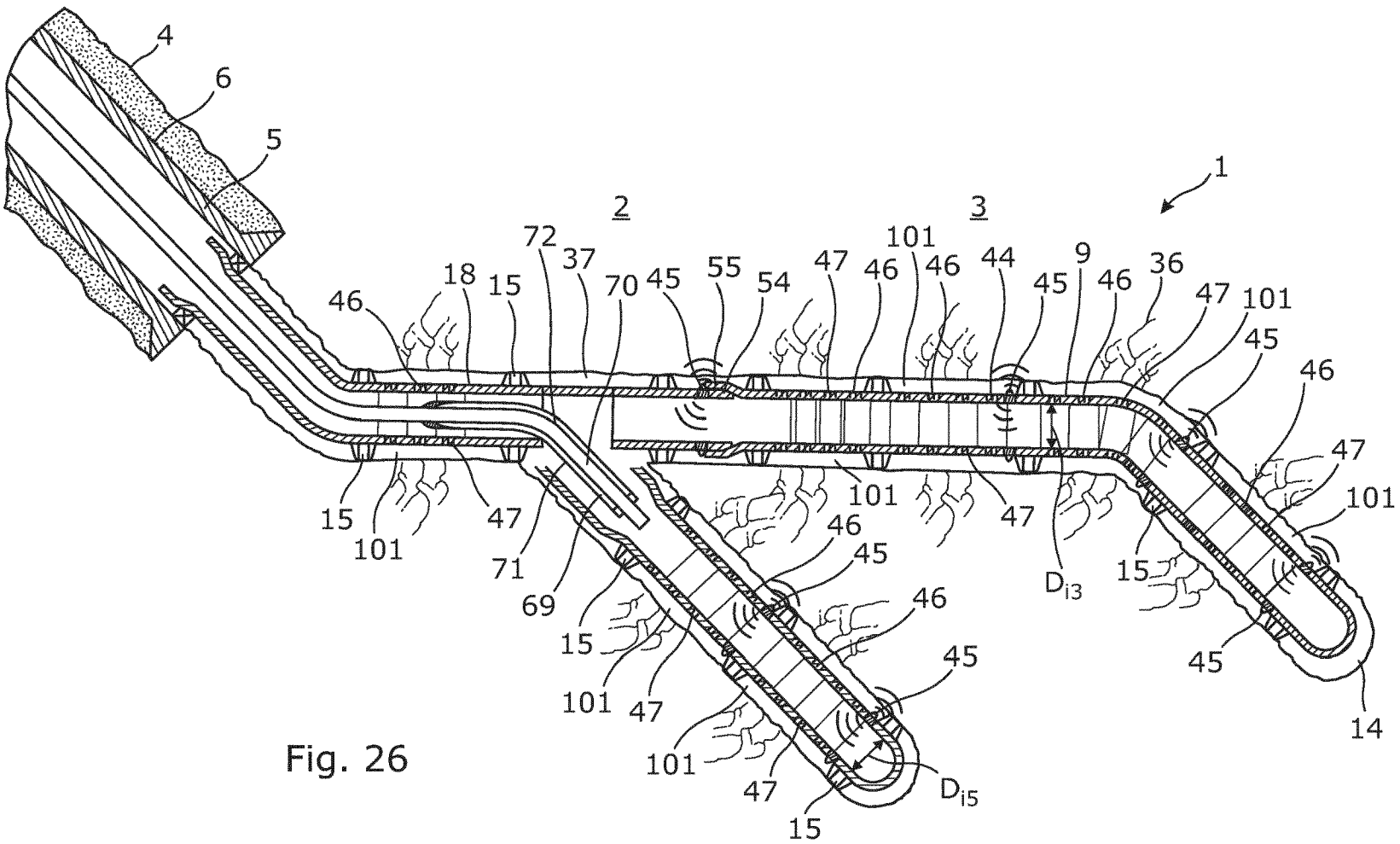
FIG. 26 shows a cross-sectional view of the completion shown in FIG. 11 after the opening has been provided and having an expansion tool inserted.
Figure 27:
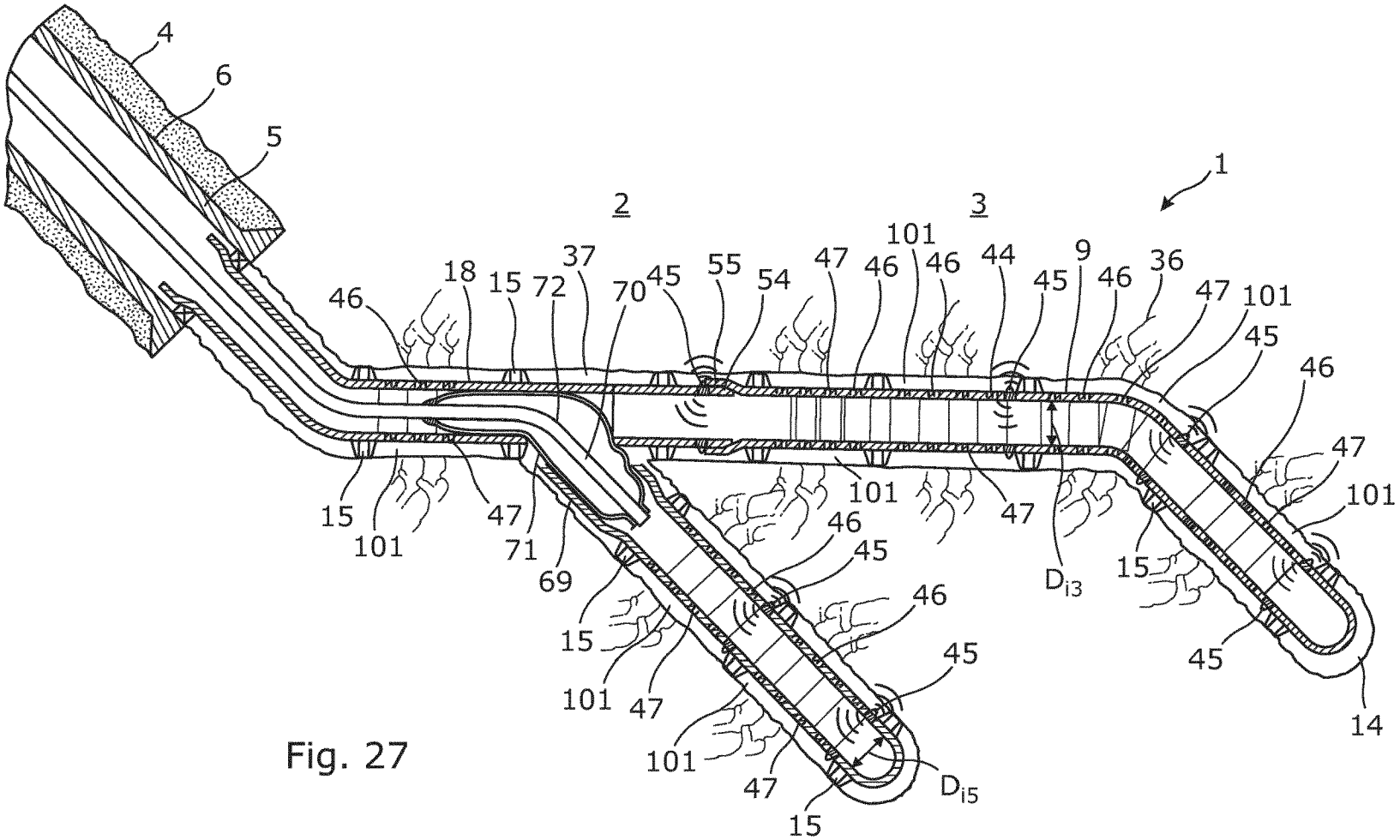
FIG. 27 shows a cross-sectional view of the completion shown in FIG. 26 after expansion of the expandable tubular.
Figure 28:
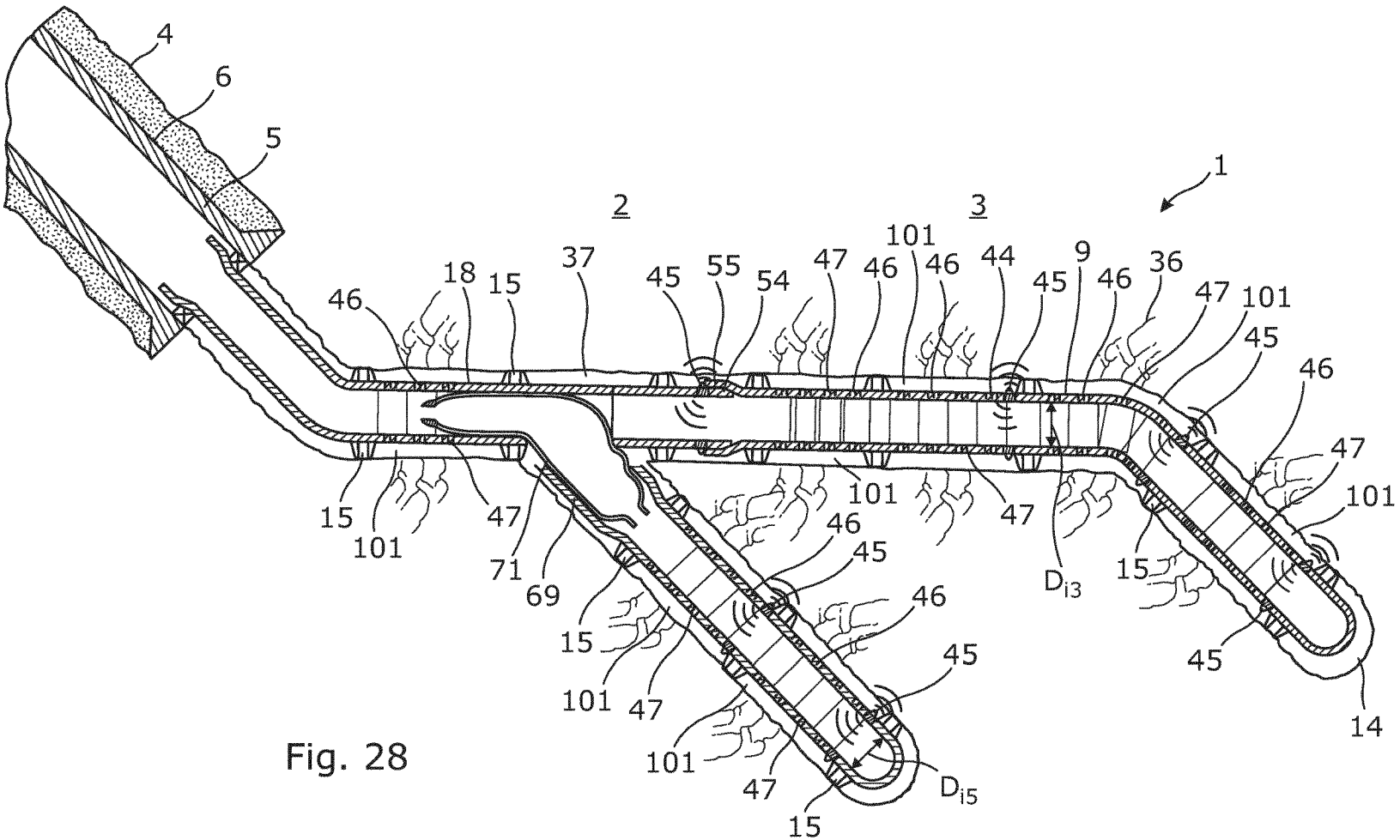
FIG. 28 shows a cross-sectional view of the completion shown in FIG. 27 after removal of the expansion tool.
Figure 29:
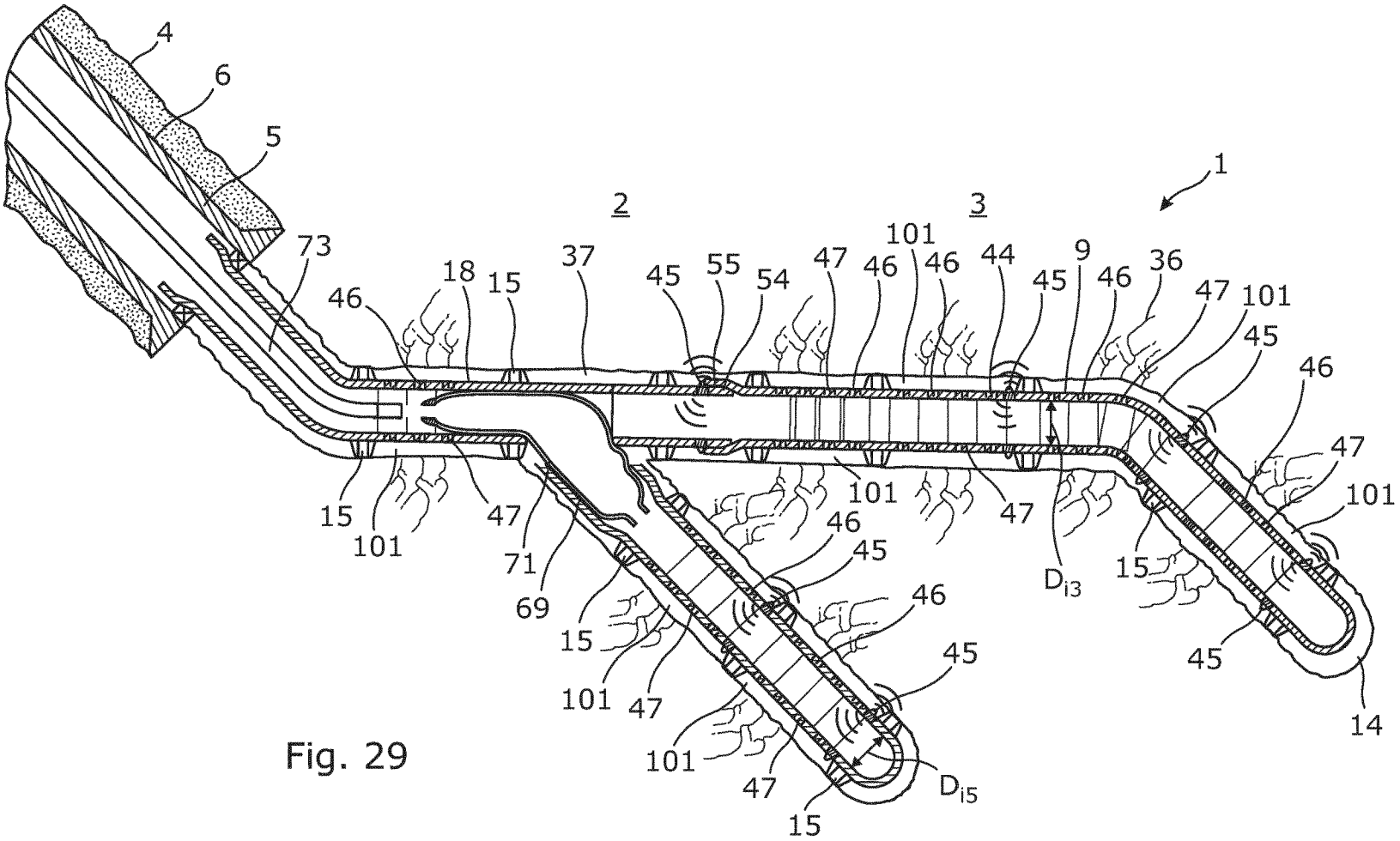
FIG. 29 shows a cross-sectional view of the completion shown in FIG. 28 as the removing tool is to remove part of the expanded expandable tubular.
Figure 30:
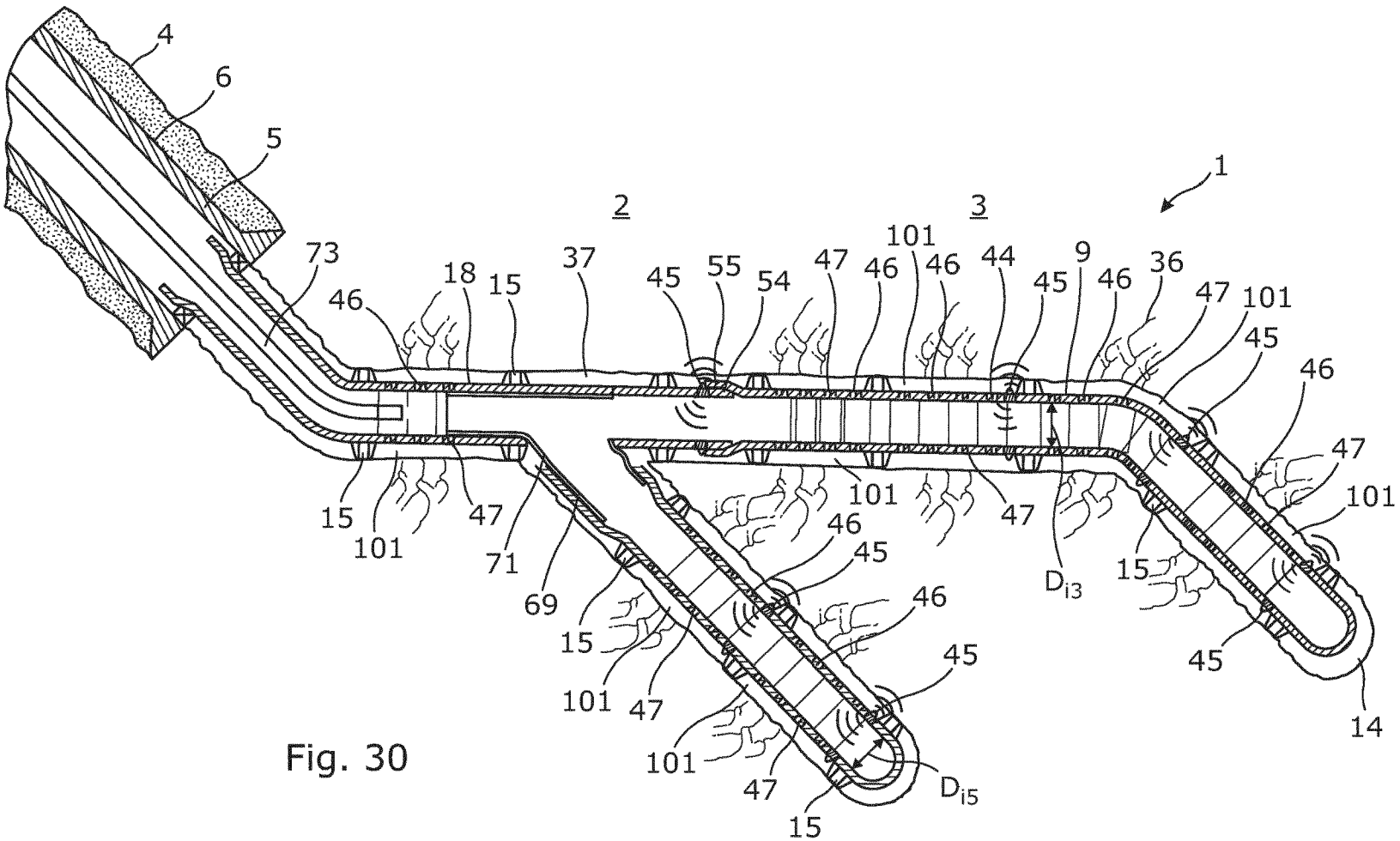
FIG. 30 shows a cross-sectional view of the completion shown in FIG. 29 after the removing tool has removed part of the expanded expandable tubular.

In FIGS. 26-30, another solution of making a lateral junction assembly 69 for providing a seal, in the form of a lateral junction assembly between the main production casing and the lateral production casing, is shown. The lateral junction assembly 69 is provided by inserting an expansion tool 70 at least partly into the lateral production casing and partly into the main production casing, as shown in FIG. 26. The tool is surrounded by an expandable tubular 71 having ends being connected to the expandable tubular. The tool has an aperture 72 opposite the expandable tubular, so that the expandable tubular is expanded by forcing pressurised fluid from the tool through the aperture into a space between the expandable tubular and the tool. The space is pressurised until the expandable tubular presses against an inner face of the main production casing and the lateral production casing forming a metal to metal seal, as shown in FIG. 27. The expandable tubular may comprise surrounding sealing elements to provide the seal between the expandable tubular and the main and lateral production casings. Subsequently, the tool is retracted, leaving the expanded expandable tubular in the production casings, as shown in FIG. 28. Then, as shown in FIG. 29, a removing tool 73 is inserted into the main production casing for removing part of the expandable tubular projecting inwards in the main production casing, and for removing part of the expandable tubular projecting inwards in the lateral production casing, and, as shown in FIG. 30, for drilling an opening in the expandable tubular for providing access to the lower production casing, creating fluid communication between the main production casing, the lower production casing and the lateral production casing. By providing the lateral junction assembly, as shown in FIG. 30, sealing the transition between the main production casing and the lateral production casing, the completion thus changes security level to a level 7. The same lateral junction assembly 69 may be provided between the lateral production casing and the sub lateral production casing 28.

The sensors 45 may be arranged both in the wall of the casing and in the casing connection parts, also called casing collars. The sensors 45 may comprise a communication unit and a memory or storage unit so that measurements from one sensor can be stored and/or sent to an adjacent sensor closer to the top of the well. The sensors 45 in the connection part may have a larger storage capacity, making the sensors capable of storing the data of measurements from all the sensors in the side track casing to which it connects. The sensors 45 in the connection parts to the sub lateral casing, the secondary sub lateral casing, the tertiary sub lateral casing and so forth may communicate with the sensors closer to the top of the well. A downhole tool can thus be submerged only in the main production casing 18 and collect all the data of measurements from all the lateral casings in one run. All the sensor data is temporarily stored in a downhole data buffering means in the tool, whereas only a first part of the sensor data, e.g. the most recent sensor data from each sensor, is transmitted from a downhole data processing means in the tool to an uphole data processing means. Thus, the downhole tool may, during the run, communicate some of the data to surface through the wireline, and while collecting the rest of the data, the downhole tool may be given the command of closing or opening some of the inflow control devices, inserting or replacing some of the sensors or inflow control devices in order to adjust the production in some production zones.

When the data from the sensor measurements are brought to surface, the data is loaded into a processing unit, and since all data from each sensor has a time stamp and a position, the temperature or pressure profile along one side track can be determined by mapping the data subsequently and independently of the order in which the data are loaded into the processing unit. Data from sensors in the tool may be used to calibrate the sensor measurements since such a sensor in a well, operating under so varying and demanding conditions, may drift over time, but this drifting is not a problem when comparing the data from the sensor with data from the tool sensors which has been measured at the same time and at the same position. In this way, the sensor measurement can be calibrated at surface.

Sensors having a communication unit may also be stored in the main production casing all the way to the top of the well. In this way, a tool being submerged into the well is no longer needed in order to obtain the information.

Each production casing may comprise several adjustable inflow control devices 46 in each production zone, so that the flow from one production zone is adjusted in volume by opening or closing some of the inflow control devices. Thus, each inflow control device may be a simple valve having two positions, either open or closed. The production zones may also comprise only a few inflow control devices where each inflow control device is adjustable between several positions for varying the volume flow from the inflow control device.

The annular barriers are made of metal, and connection ring elements are mounted on the outer surface of the tubular part forming part of the casing for connecting the expandable sleeve with the tubular part. The opening in the tubular part may be provided with an inflow control device closing after the expansion.

For isolating a production zone, the casing may comprise two annular barriers arranged on each side of the production zone. Furthermore, when an impermeable part of the formation is used for forming a fluid connection between two casings, a double set of barriers may also be used in order to seal off this connection area/zone.

Even though not shown, a base structure may be positioned at the top of the well e.g. on the ground, on the seabed, on a rig or a platform.

In some circumstances, after drilling the lateral bore and inserting a casing, a connection part 55 may be mounted in the opening before inserting the lateral production casing into the lateral bore. The fluid connection between the main production casing and the lateral production casing may be substantially fluid-tight.

When the production casing of the main bore, the lateral bore, the sub lateral bore etc. has been inserted into the bore and before the step of pressurising the production casing, the production casing may be flushed with well fluid or fluid comprising chemicals.

Also, a ball may be dropped into the side track casing before the pressurising step in order to expand the annular barriers.

The annular barriers may be expanded in numerous ways. For instance the step of pressurising the production casing may be performed by setting a plug between the connection part (if inserted in the opening) and the second annular barrier of the main casing, and then pressurising from the top of the main casing and into the lateral production casing, whereby the annular barriers of the lateral production casing are expanded.

The different production casings of the completion systems may comprise one or more inflow control devices arranged between two adjacent annular barriers, and the production casings may also comprise blank parts. However, when the casings have been inserted into the boreholes, one or more inflow control devices may subsequently be mounted in the production casings, preferably in the blank parts of the casings. The inflow control devices in the casings may be opened or closed, or even inflow volume-adjusted.

Furthermore, the different production casings of the completion systems may comprise one or more sensors for monitoring the completion and the formation. However, when the production casings have been inserted into the boreholes, one or more sensors may also be mounted in the production casings, or existing sensors may be replaced. The sensors are being activated and data from the sensors are transmitted wirelessly.

By the downhole completion system according to the present invention, a completion production method for enhancing a production of hydrocarbon-containing fluid in a reservoir is obtained. The completion production method may comprise the steps of adjusting inflow volume of inflow control devices for providing an optimum fluid flow from the main casing and/or side track casings, and/or inserting and/or replacing inflow control devices in the casings.

Advantageously, the steps of adjusting, inserting and replacing inflow control devices are performed by a downhole tool submerged into the casings and being movable. Indeed, by the present invention it is obtained that the completion system is flexible in view of operation, since the downhole tool may be submerged into the casings for operating and handling the different downhole components.

Furthermore, the data received from the sensors and/or the inflow control devices may be transmitted to the surface for interpretation with respect to formation pressure, flow, content, production and/or sweep, so that optimisation of the productivity of the completion system is facilitated.

On the basis of the transmitted data, it is determined if the inflow control devices are to be adjusted or replaced in the casings, or whether to insert additional inflow control devices in the blank parts by means of the downhole tool.

Furthermore, on the basis of transmitted data, it is determined if additional sub lateral bores, secondary sub lateral bores and/or tertiary sub lateral bores etc. should be provided in the completion system for enhancing the productivity. In addition, the sensors may be calibrated, adjusted, inserted and/or replaced by means of the downhole tool submerged into the casings.

By fluid or well fluid is meant any kind of fluid that may be present in oil or gas wells downhole, such as natural gas, oil, oil mud, crude oil, water etc. By gas is meant any kind of gas composition present in a well, completion, or open hole, and by oil is meant any kind of oil composition, such as crude oil, an oil-containing fluid etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A completion method for completing a uniform inner bore downhole completion system in a reservoir in a formation, comprising the sequential steps of:

drilling a hole in the formation, inserting a surface casing having an inner surface casing diameter, cementing an outer face of the surface casing to the hole, inserting a drilling head in the surface casing, drilling a main bore extending from the surface casing, the main bore having a first part and a second part, the second part comprising an end of the main bore, and the main bore having an inner main bore diameter which is substantially the same as the inner surface casing diameter of the surface casing, retracting the drilling head from the main bore and the surface casing, inserting a lower production casing in the second part of the main bore via the surface casing, the lower production casing having annular barriers and an inner diameter, setting at least one of the annular barriers of the lower production casing, inserting the drilling head into the first part of the main bore below the surface casing, drilling a lateral bore from the first part of the main bore, the lateral bore having an inner lateral bore diameter which is substantially equal to the inner main bore diameter, retracting the drilling head from the lateral bore, inserting via the surface casing a lateral production casing fully in the lateral bore, the lateral production casing having annular barriers and an inner diameter which is substantially equal to the inner diameter of the lower production casing providing a uniform inner bore completion having the same inner diameter in all production casings, enabling service also in the lateral production casing while service of the lower production casing is performed, setting at least one of the annular barriers of the lateral production casing, after the lateral casing has been set, inserting via the surface casing a main production casing in the first part of the main bore, so that the main production casing is fluidly connected with the lower production casing, the main production casing having annular barriers and an inner diameter which is substantially equal to the inner diameter of the lower production casing, setting the annular barriers of the main production casing, and providing an opening in the main production casing by removing a portion of the main production casing after the main production casing has been set, the opening being located opposite the lateral production casing fluidly connecting the lateral production casing with the main production casing, so that the lower production casing, the main production casing and the lateral production casing is in fluid communication.

2. A completion method according to claim 1, wherein the lateral bore has a first part and a second part, the second part comprising an end of the lateral bore, and the lateral production casing is a lower lateral production casing arranged in the second part of the lateral bore, and before the step of inserting the main production casing in the first part of the main bore, the method comprises the steps of:

drilling a sub lateral bore extending from the first part of the lateral bore, the sub lateral bore having an inner sub lateral bore diameter which is substantially equal to the inner main bore diameter, inserting a sub lateral production casing in the sub lateral bore, the sub lateral production casing having annular barriers and an inner diameter which is substantially equal to the inner diameter of the lower production casing, setting the annular barriers of the sub lateral production casing, inserting a second lateral production casing arranged in the first part of the lateral bore, and setting the annular barriers of the second lateral production casing.

3. A completion method according to claim 2, further comprising the step of providing an opening in the second lateral production casing opposite the sub lateral production casing, the opening fluidly connecting the sub lateral production casing with the second lateral production casing before or after the step of providing an opening in the main production casing.

4. A completion method according to claim 1, wherein the steps of providing one or more lateral bores, one or more sub lateral bores, one or more secondary sub lateral bores, and so forth with production casings are performed before the step of inserting a main production casing in the first part of the main bore.

5. A completion method according to claim 1, further comprising the step of inserting an openhole whipstock in the first part of the main bore before drilling the lateral bore.

6. A completion method according to claim 1, further comprising the step of expanding the annular barriers by pressurising the production casing simultaneously or subsequently to the step of setting at least one of the annular barriers.

7. A completion method according to claim 1, further comprising the step of fracturing the formation through the production casing, such as the lower production casing, before the step of drilling the lateral bore.

8. A completion method according to claim 7, wherein the step of fracturing the production casing is performed by means of an isolation tool having a hollow tube and two circumferenting annular inflatable packers adapted to isolate a fracturing zone opposite a zone in the formation to be fractured.

9. A completion method according to claim 7, wherein the step of inserting the lower production casing is performed by means of an isolation tool having a hollow tube and two circumferenting annular inflatable packers adapted to isolate a fracturing zone opposite a zone in the formation to be fractured.

10. A completion method according to claim 1, wherein a plug is set in the lower production casing for protecting the lower production casing during subsequent steps.

11. A completion method according to claim 1, further comprising the step of mounting the production casing from a plurality of components having equal inner diameters.

12. A completion method according to claim 1, further comprising the step of making a lateral junction assembly by the following steps:

inserting an expansion tool or an isolation tool at least partly in the lateral production casing, the tool being surrounded by an expandable tubular, the expandable tubular having ends connected to the expandable tubular, the tool having an aperture opposite the expandable tubular, expanding the expandable tubular by forcing pressurised fluid through the aperture until the expandable tubular presses against an inner face of the main production casing and the lateral production casing, retracting the tool leaving the expandable tubular in the production casings, inserting a removing tool into the main production casing, removing part of the expandable tubular projecting inwards in the main production casing, removing part of the expandable tubular projecting inwards in the lateral production casing, drilling an opening in the expandable tubular for providing access to the lower production casing, and removing the removing tool from the completion.

13. A downhole completion system for enhancing hydrocarbon-containing fluid production in a reservoir, the downhole completion system comprising:

a surface casing inserted and cemented in a hole, the surface casing having an inner surface casing diameter, a main bore extending from the surface casing, the main bore having a first part and a second part, the second part comprising an end of the main bore, and the main bore having substantially the same inner main bore diameter as the inner surface casing diameter of the surface casing, a lower production casing arranged in the second part of the main bore, the lower production casing having annular barriers and an inner diameter, a lateral bore extending from the first part of the main bore, the lateral bore having an inner lateral bore diameter, a lateral production casing fully arranged in the lateral bore, the lateral production casing having annular barriers and an inner diameter, the lateral production casing and the lower production casing providing a uniform inner bore completion having the same inner diameter in all production casings, a main production casing arranged in the first part of the main bore in fluid communication with the lower production casing, the main production casing having annular barriers and an inner diameter which is substantially equal to the inner diameter of the lower production casing, and an opening in the main production casing opposite the lateral production casing, the opening fluidly connecting the lateral production casing with the main production casing, so that the main production casing is fluidly connected with the lower production casing, wherein the inner lateral bore diameter is substantially equal to the inner main bore diameter, and wherein the inner diameter of the lateral production casing is substantially equal to the inner diameter of the lower production casing.

14. A downhole completion system according to claim 13, wherein the main production casing is formed by a first main production casing and a second main production casing, wherein the second main production casing is arranged in the first part of the main bore between the lower production casing and the first main production casing.

15. A downhole completion system according to claim 13, further comprising a second lateral bore extending from the first part of the main bore, and a second lateral production casing arranged in the second lateral bore, the second lateral production casing having annular barriers and an inner diameter, the inner diameter of the second lateral production casing being substantially equal to the inner diameter of the lower production casing.

16. A downhole completion system according to claim 13, wherein the lateral bore has a first part and a second part, the second part comprising an end of the lateral bore, and the lateral production casing is a lower lateral production casing arranged in the second part of the lateral bore, the lower lateral production casing having annular barriers and an inner diameter, and a sub lateral bore extends from the first part of the lateral bore, and a sub lateral production casing is arranged in the sub lateral bore, the sub lateral production casing having annular barriers and an inner sub lateral casing diameter, and a second lateral production casing is arranged in the first part of the lateral bore, the second lateral production casing having annular barriers and an inner diameter being substantially equal to the inner diameter of the lower lateral production casing, and wherein an opening in the second lateral production casing is arranged opposite the sub lateral production casing, the opening fluidly connecting the sub lateral production casing with the second lateral production casing, wherein the inner sub lateral casing diameter is substantially equal to the inner diameter of the lower production casing.

17. A downhole completion system according to claim 13, wherein the production casings are mounted from a plurality of components having equal inner diameters, the components being selected from the group of annular barriers, inflow control valves, fracturing ports, sensor modules, blank casing parts or junctions.

18. A downhole completion system according to claim 13, further comprising a lateral junction assembly arranged partly in the main production casing and partly in the lateral production casing.

19. A downhole completion system according to claim 18, wherein the lateral junction assembly comprises an expandable tubular which may be expanded by an expansion tool.

* * * * *